US009897359B2

(12) United States Patent
Morimoto et al.

(10) Patent No.: US 9,897,359 B2
(45) Date of Patent: Feb. 20, 2018

(54) AIR-CONDITIONING APPARATUS

(75) Inventors: Osamu Morimoto, Tokyo (JP); Daisuke Shimamoto, Tokyo (JP); Koji Azuma, Tokyo (JP); Takayoshi Honda, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 941 days.

(21) Appl. No.: 14/347,798

(22) PCT Filed: Jan. 18, 2012

(86) PCT No.: PCT/JP2012/000258

§ 371 (c)(1),
(2), (4) Date: Mar. 27, 2014

(87) PCT Pub. No.: WO2013/108290

PCT Pub. Date: Jul. 25, 2013

(65) Prior Publication Data

US 2014/0305152 A1 Oct. 16, 2014

(51) Int. Cl.
*F25B 49/00* (2006.01)
*F25B 49/02* (2006.01)
(Continued)

(52) U.S. Cl.
CPC ..... *F25B 49/02* (2013.01); *F24F 3/06* (2013.01); *F24F 2011/0045* (2013.01);
(Continued)

(58) Field of Classification Search
CPC ..... F25B 49/02; F25B 25/005; F25B 49/005; F25B 2313/0231; F25B 2313/02741;
(Continued)

(56) References Cited

U.S. PATENT DOCUMENTS

2004/0145119 A1* 7/2004 Nakamura ..... F16C 29/025 277/409
2006/0018677 A1* 1/2006 Kim ..... G03G 15/104 399/57
(Continued)

FOREIGN PATENT DOCUMENTS

EP 1 707 886 A2 1/2006
EP 1707886 A2 * 10/2006 ..... F24D 19/1039
(Continued)

OTHER PUBLICATIONS

Office Action dated Dec. 21, 2015 in the corresponding CN application No. 201280062523.8 (with English translation).
(Continued)

*Primary Examiner* — Frantz Jules
*Assistant Examiner* — Steve Tanenbaum
(74) *Attorney, Agent, or Firm* — Posz Law Group, PLC

(57) ABSTRACT

An air-conditioning apparatus includes a refrigeration cycle that includes one or more intermediate heat exchangers, exchanging heat between a heat source side refrigerant and a heat medium different from the heat source side refrigerant, a heat medium circuit that includes at least one pump configured to circulate the heat medium for heat exchange by the intermediate heat exchanger, a use side heat exchanger configured to exchange heat between the heat medium and air in an air-conditioning target space, and flow switching valves configured to switch between passing the heated heat medium through the use side heat exchanger and passing the cooled heat medium through the use side heat exchanger and in which the pump, the use side heat exchanger, and the flow switching valves are connected by pipes, and a controller configured to calculate an actual temperature efficiency ratio based on a temperature at a heat medium inlet of the heat exchanger in the heat medium circuit and determine whether a flow rate of the heat medium
(Continued)

in the heat medium circuit is abnormal based on the actual temperature efficiency ratio and a set reference temperature efficiency ratio.

12 Claims, 8 Drawing Sheets

(51) Int. Cl.
*F24F 3/06* (2006.01)
*F24F 11/00* (2018.01)
*F25B 25/00* (2006.01)

(52) U.S. Cl.
CPC ..... *F24F 2011/0083* (2013.01); *F25B 25/005* (2013.01); *F25B 49/005* (2013.01); *F25B 2313/0231* (2013.01); *F25B 2313/02741* (2013.01)

(58) Field of Classification Search
CPC ..... F25B 2500/22; F25B 2500/221; F25B 2500/222; F25B 2500/24; F24F 3/06; F24F 2011/0045; F24F 2011/0083
See application file for complete search history.

(56) References Cited

U.S. PATENT DOCUMENTS

| | | | | |
|---|---|---|---|---|
| 2011/0192184 | A1* | 8/2011 | Yamashita | F24F 1/02 62/196.1 |
| 2011/0302941 | A1 | 12/2011 | Takata | |

FOREIGN PATENT DOCUMENTS

| | | | | |
|---|---|---|---|---|
| JP | 2006-266587 | A | | 10/2006 |
| JP | 2009-243828 | A | | 10/2009 |
| JP | 2009243828 | A | * | 10/2009 |
| JP | 2010-091181 | A | | 4/2010 |
| JP | 2010-127568 | A | | 6/2010 |
| JP | 2010127568 | A | * | 6/2010 |
| JP | 2010-223542 | A | | 10/2010 |
| JP | 2011-226704 | A | | 11/2011 |
| WO | 2010/049998 | A1 | | 5/2010 |
| WO | 2010/109617 | A1 | | 9/2010 |

OTHER PUBLICATIONS

Extended European Search Report dated Sep. 14, 2015 in the corresponding EP application No. 12866077.6.

Office Action dated Mar. 24, 2015 in corresponding JP Application No. 2013-554069 (with English translation).

International Search Report of the International Searching Authority dated Apr. 24, 2012 for the corresponding international application No. PCT/JP2012/000258.

* cited by examiner

AIR-CONDITIONING APPARATUS

CROSS REFERENCE TO RELATED APPLICATION

This application is a U.S. national stage application of International Patent Application No. PCT/JP2012/000258 filed on Jan. 18, 2012.

TECHNICAL FIELD

The present invention relates to an air-conditioning apparatus which is used as, for example, a multi-air-conditioning apparatus for a building.

BACKGROUND

There is an air-conditioning apparatus that allows a heat source side refrigerant circulated through a refrigeration cycle (refrigerant circuit) to exchange heat with an indoor side refrigerant (heat medium) circulated through a heat medium circuit. The refrigeration cycle includes an outdoor unit and a relay unit connected by pipes. The heat medium circuit includes the relay unit and an indoor unit connected by pipes. Air-conditioning apparatuses having such a configuration used as building multi-air-conditioning apparatuses include an air-conditioning apparatus configured such that conveyance power for the heat medium is reduced to achieve energy saving (refer to Patent Literature 1, for example). The reason why the two circuits are arranged as described above is that a refrigerant, such as water, having no adverse effects on health of users in a building can be used as the heat medium circulated in an indoor space.

CITATION LIST

Patent Literature

Patent Literature 1: International Publication No. WO 2010/049998 (p. 3, FIG. 1, for example)

Technical Problem

For example, typical air-conditioning apparatuses for conditioning air without using any heat medium have been designed so that the leakage of a refrigerant can be immediately detected and dealt with in consideration of influences on users. On the other hand, little attention has been focused on detection of the leakage of a heat medium from a heat medium circuit in an air-conditioning apparatus like that disclosed in Patent Literature 1 described above because the heat medium circulated in an indoor space exerts little adverse effect on users.

However, the leakage of the heat medium, for example, will affect air conditioning control, components, and the like. For instance, if the heat medium leaks from the heat medium circuit through which the heat medium is circulated by a pump, air may enter the heat medium circuit, thus causing air entrainment in the pump. This may result in a significantly reduced circulation of the heat medium. Unfortunately, the pump may be overheated and broken. Alternatively, if current supplied to the pump or the temperature of the pump is affected by the leakage of the heat medium, the pump may have been damaged. At worst, the pump may be broken.

Although the leakage or the like of the heat medium can be detected on the basis of a change in temperature of the heat medium, it is difficult to accurately detect the leakage because the degree of change in temperature of the heat medium varies with the amount of water.

SUMMARY

The present invention has been made to solve the above-described disadvantage and provides an air-conditioning apparatus capable of more efficiently detecting abnormality in flow rate of a heat medium flowing through a heat medium circuit.

The present invention provides an air-conditioning apparatus including a refrigeration cycle configured by connecting, by a pipe, a compressor configured to compress a heat source side refrigerant, a refrigerant flow switching device configured to switch between paths for circulation of the heat source side refrigerant, a heat source side heat exchanger configured to allow the heat source side refrigerant to exchange heat, an expansion device configured to regulate the pressure of the heat source side refrigerant, and at least one intermediate heat exchanger configured to exchange heat between the heat source side refrigerant and a heat medium different from the heat source side refrigerant and in which the compressor, the refrigerant flow switching device, a heat medium circuit configured by connecting, by a pipe, at least one pump configured to circulate the heat medium for heat exchange by the intermediate heat exchanger, a use side heat exchanger configured to exchange heat between the heat medium and air in an air-conditioning target space, and a flow switching valve configured to switch between passing the heated heat medium through the use side heat exchanger and passing the cooled heat medium through the use side heat exchanger, and a controller configured to calculate an actual temperature efficiency ratio based on a temperature at a heat medium inlet of the heat exchanger in the heat medium circuit and determine whether a flow rate of the heat medium in the heat medium circuit is abnormal based on the actual temperature efficiency ratio and a set reference temperature efficiency ratio.

In the air-conditioning apparatus according to the present invention, since the controller determines whether abnormality in flow rate has occurred based on the temperature efficiency ratio related to heat exchange by the heat exchanger in the heat medium circuit. Thus, the abnormality in flow rate can be determined accurately and efficiently.

DETAILED DESCRIPTION

Embodiment 1

Figure 1:
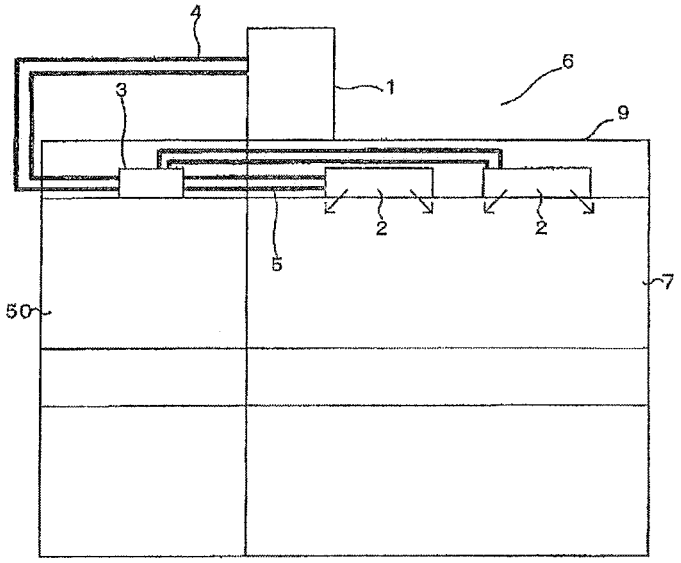
FIG. 1 is an overall configuration diagram illustrating an exemplary installation state of an air-conditioning apparatus according to Embodiment 1.
Figure 2:
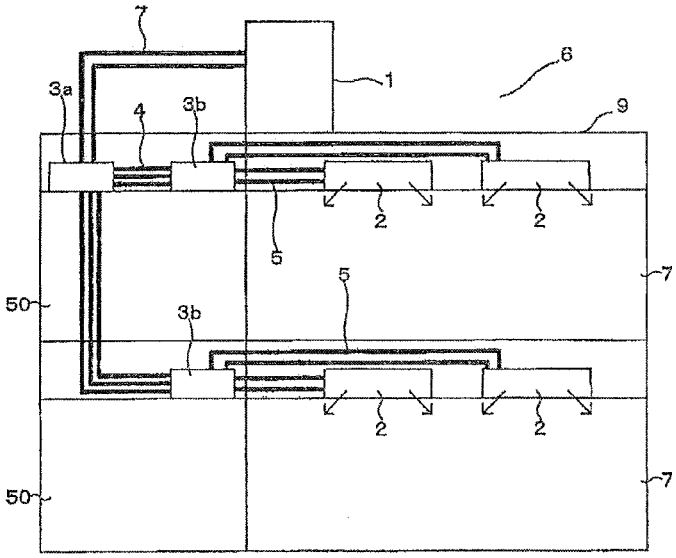
FIG. 2 is an overall configuration diagram illustrating another exemplary installation state of the air-conditioning apparatus according to Embodiment 1.

FIGS. 1 and 2 are overall configuration diagrams each illustrating an exemplary installation state of an air-conditioning apparatus according to Embodiment 1 of the present invention. The configuration of the air-conditioning apparatus will be described with reference to FIGS. 1 and 2. This air-conditioning apparatus uses a refrigeration cycle through which a heat source side refrigerant is circulated and a heat medium circuit through which a heat medium, such as water or antifreeze, is circulated, and is configured to perform a cooling operation or a heating operation. Note that the dimensional relationship among components in FIG. 1 and the following figures may be different from the actual one. Furthermore, in the following description, when a plurality of devices of the same kind distinguished from one another using subscripts do not have to be distinguished from one another or specified, the subscripts may be omitted. As regards levels of temperature, pressure, or the like, the levels are not determined in relation to a particular absolute value but are relatively determined depending on, for example, a state or operation of a system, an apparatus, or the like.

As illustrated in FIG. 1, the air-conditioning apparatus according to Embodiment 1 includes a single heat source unit 1, such as a heat source device, a plurality of indoor units 2, and a relay unit 3 disposed between the heat source unit 1 and the indoor units 2. The relay unit 3 is configured to exchange heat between the heat source side refrigerant and the heat medium. The heat source unit 1 is connected to the relay unit 3 by refrigerant pipes 4 through which the heat source side refrigerant is conveyed and the relay unit 3 is connected to each indoor unit 2 by pipes 5 through which the heat medium is conveyed, such that cooling energy or heating energy produced in the heat source unit 1 is delivered to the indoor units 2. Note that the number of heat source units 1 connected, the number of indoor units 2 connected, and the number of relay units 3 connected are not limited to the numbers illustrated in FIG. 1.

The heat source unit 1 is typically disposed in an outdoor space 6 that is a space outside a structure 9, such as a building, and is configured to supply cooling energy or heating energy to the indoor units 2 via the relay unit 3. Each indoor unit 2 is disposed in a living space 7, such as a living room or a server room inside the structure 9, to which cooling air or heating air can be conveyed, and is configured to supply the cooling air or the heating air to the living space 7, serving as an air-conditioning target area. The relay unit 3 includes a housing separated from housings of the heat source unit 1 and the indoor units 2 such that the relay unit 3 can be disposed in a different position (hereinafter, referred to as a "non-living space 50") from those of the outdoor space 6 and the living spaces 7. The relay unit 3 connects the heat source unit 1 and the indoor units 2 to transfer cooling energy or heating energy, supplied from the heat source unit 1, to the indoor units 2.

The outdoor space 6 is supposed to be a place outside the structure 9, for example, a roof as illustrated in FIG. 1. The non-living space 50 is supposed to be a place that is inside the structure 9 but is different from the living spaces 7, specifically, a place (e.g., a space above a corridor) in which people do not exist at all times, a space above a ceiling of a shared zone, a shared space in which an elevator or the like is installed, a machine room, a computer room, a stockroom, or the like. The living space 7 is supposed to be a place that is inside the structure 9 and in which people exist at all times, or many or a few people temporarily exist, for example, an office, a classroom, a conference room, a dining hall, a server room, or the like.

The heat source unit 1 and the relay unit 3 are connected using two refrigerant pipes 4. The relay unit 3 and each indoor unit 2 are connected using two pipes 5. Connecting the heat source unit 1 to the relay unit 3 using the two refrigerant pipes 4 and connecting each indoor unit 2 to the relay unit 3 using the two pipes 5 in this manner facilitate construction of the air-conditioning apparatus.

As illustrated in FIG. 2, the relay unit 3 may be separated into a single first relay unit 3*a* and two second relay units 3*b* derived from the first relay unit 3*a*. This separation allows a plurality of the second relay units 3*b* to be connected to the single first relay unit 3*a*. In this configuration, the first relay unit 3*a* is connected to each second relay unit 3*b* by three refrigerant pipes 4. The pipe arrangement will be described in detail later.

Although FIGS. 1 and 2 illustrate the indoor units 2 which are of a ceiling cassette type, the indoor units are not limited to this type and may be of any type, such as a ceiling concealed type or a ceiling suspended type, capable of supplying cooling energy or heating energy into the living space 7 directly or through a duct or the like.

Although FIG. 1 illustrates the heat source unit 1 disposed in the outdoor space 6, the arrangement is not limited to this illustration. For example, the heat source unit 1 may be disposed in an enclosed space, for example, a machine room with a ventilation opening. The heat source unit 1 may be disposed inside the structure 9 as long as waste heat can be exhausted through an exhaust duct to the outside of the structure 9. Alternatively, if the heat source unit 1 of a water-cooled type is used, the heat source unit 1 may be disposed inside the structure 9. Even when the heat source unit 1 is disposed in such a place, no problem in particular will occur.

Furthermore, the relay unit 3 can be disposed near the heat source unit 1. If the distance between the relay unit 3 and each indoor unit 2 is too large, the conveyance power for the heat medium would be considerably large, leading to a reduction in the effect of energy saving.

Figure 3:
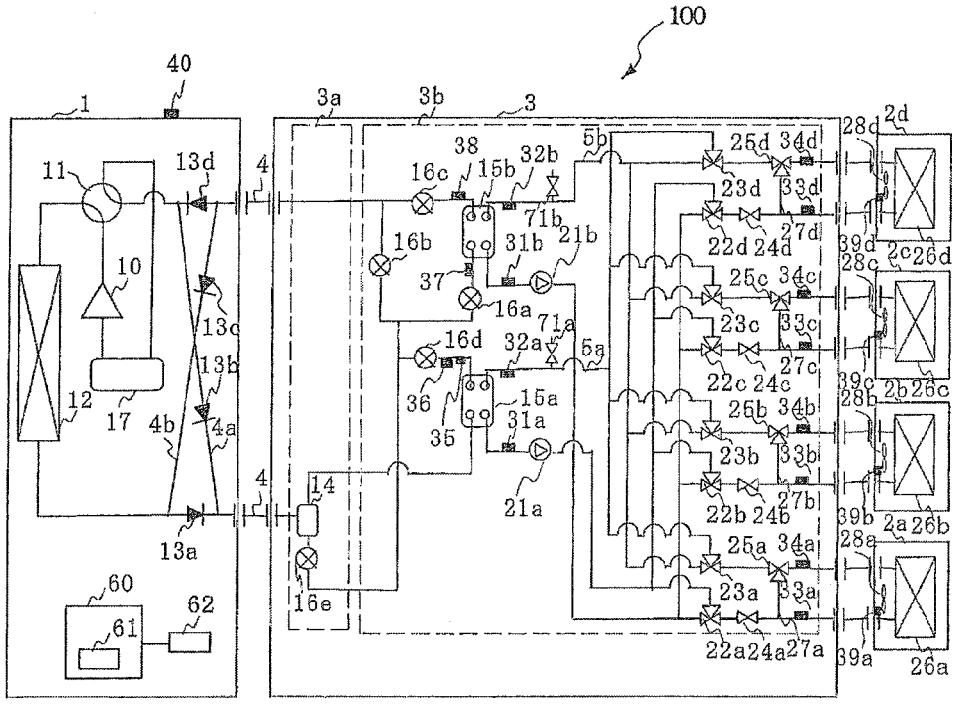
FIG. 3 is a schematic circuit diagram illustrating the configuration of the air-conditioning apparatus according to Embodiment 1.

FIG. 3 is a schematic circuit diagram illustrating the configuration of an air-conditioning apparatus 100 according to Embodiment 1 of the present invention. FIG. 3 illustrates an exemplary configuration of the air-conditioning apparatus including a refrigeration cycle and a heat medium circuit. The configuration of the air-conditioning apparatus 100 will be described in detail with reference to FIG. 3. Referring to FIG. 3, the heat source unit 1 and the relay unit 3 are connected through a first intermediate heat exchanger 15*a* and a second intermediate heat exchanger 15*b* which are arranged in the second relay unit 3*b*. The relay unit 3 and each indoor unit 2 are connected through the first intermediate heat exchanger 15*a* and the second intermediate heat exchanger 15*b* arranged in the second relay unit 3*b*. The configurations and functions of components included in the air-conditioning apparatus 100 will be described below. FIG. 3 and the following figures illustrate an arrangement in which the relay unit 3 is separated into the first relay unit 3*a* and the second relay unit 3*b*.

(Heat Source Unit 1)

The heat source unit 1 includes a compressor 10, a four-way valve 11, a heat source side heat exchanger (outdoor heat exchanger) 12, and an accumulator 17 which are connected in series by the refrigerant pipes 4. The heat source unit 1 further includes a first connecting pipe 4*a*, a second connecting pipe 4*b*, a check valve 13*a*, a check valve 13*b*, a check valve 13*c*, and a check valve 13*d*. The arrangement of the first connecting pipe 4*a*, the second connecting pipe 4*b*, and the check valves 13*a*, 13*b*, 13*c*, and 13*d* enables the heat source side refrigerant, allowed to flow into the relay unit 3, to flow in a given direction irrespective of an operation requested by any indoor unit 2.

The compressor 10 is configured to suck the heat source side refrigerant and compress the heat source side refrigerant into a high-temperature high-pressure state and may be, for example, a capacity-controllable inverter compressor. The four-way valve 11 is configured to switch between the direction of flow of the heat source side refrigerant during the heating operation and the direction of flow of the heat source side refrigerant during the cooling operation. The heat source side heat exchanger 12 is configured to function as an evaporator during the heating operation and function as a condenser during the cooling operation so as to exchange heat between the heat source side refrigerant and air supplied from an air-sending device (not illustrated), such as a fan, such that the heat source side refrigerant evaporates and gasifies or condenses and liquefies. The accumulator 17 is disposed on a suction side of the compressor 10 and is configured to store an excess of the refrigerant.

The check valve 13*d* is disposed in the refrigerant pipe 4 between the relay unit 3 and the four-way valve 11 and is configured to permit the heat source side refrigerant to flow only in a predetermined direction (the direction from the relay unit 3 to the heat source unit 1). The check valve 13*a* is provided to the refrigerant pipe 4 between the heat source side heat exchanger 12 and the relay unit 3 and is configured to permit the heat source side refrigerant to flow only in a predetermined direction (the direction from the heat source unit 1 to the relay unit 3). The check valve 13*b* is disposed in the first connecting pipe 4*a* and is configured to permit the heat source side refrigerant to flow only in a direction from a point downstream of the check valve 13*d* to a point downstream of the check valve 13*a*. The check valve 13*c* is disposed in the second connecting pipe 4*b* and is configured to permit the heat source side refrigerant to flow only in a direction from a point upstream of the check valve 13*d* to a point upstream of the check valve 13*a*.

The first connecting pipe 4*a* connects the refrigerant pipe 4 downstream of the check valve 13*d* and the refrigerant pipe 4 downstream of the check valve 13*a* in the heat source unit 1. The second connecting pipe 4*b* connects the refrigerant pipe 4 upstream of the check valve 13*d* and the refrigerant pipe 4 upstream of the check valve 13*a* in the heat source unit 1. Although FIG. 2 illustrates an exemplary arrangement of the first connecting pipe 4*a*, the second connecting pipe 4*b*, and the check valves 13*a*, 13*b*, 13*c*, and 13*d*, the arrangement is not limited to this illustration. These components do not necessarily have to be arranged.

(Indoor Units 2)

The indoor units 2 each include a use side heat exchanger 26. The use side heat exchanger 26 is connected through the pipes 5 to a stop valve 24 and a flow control valve 25 which are arranged in the second relay unit 3*b*. The use side heat exchanger 26 is configured to exchange heat between the heat medium and air supplied by driving of an indoor fan 28 in order to produce heating air or cooling air to be supplied to the air-conditioning target area.

FIG. 3 illustrates an exemplary arrangement of four indoor units 2 connected to the second relay unit 3*b*. An indoor unit 2*a*, an indoor unit 2*b*, an indoor unit 2*c*, and an indoor unit 2*d* are illustrated in that order from the bottom of the drawing sheet. In addition, the use side heat exchangers 26 are illustrated as a use side heat exchanger 26*a*, a use side heat exchanger 26*b*, a use side heat exchanger 26*c*, and a use side heat exchanger 26*d* in that order from the bottom of the drawing sheet so as to correspond to the indoor units 2*a* to 2*d*, respectively. Similarly, the indoor fans 28 are illustrated as an indoor fan 28*a*, an indoor fan 28*b*, an indoor fan 28*c*, and an indoor fan 28*d* in that order from the bottom of the drawing sheet. Note that the number of indoor units 2 connected is not limited to four, as illustrated in FIG. 3, as in the case of FIG. 1.

(Relay Unit 3)

The relay unit 3 is composed of the first relay unit 3*a* and the second relay unit 3*b* which include separate housings. As described above, this configuration enables a plurality of second relay units 3*b* to be connected to the single first relay unit 3*a*. The first relay unit 3*a* includes a gas-liquid separator 14 and an expansion valve 16*e*. The second relay unit 3*b* includes the two intermediate heat exchangers 15, four expansion valves 16, two pumps 21, four flow switching valves 22, four flow switching valves 23, the four stop valves 24, and the four flow control valves 25.

The gas-liquid separator 14 is connected to one refrigerant pipe 4 that connects to the heat source unit 1 and two refrigerant pipes 4 that connect to the first intermediate heat exchanger 15*a* and the second intermediate heat exchanger 15*b* in the second relay unit 3*b*, and is configured to separate the heat source side refrigerant supplied from the heat source unit 1 into a vapor refrigerant and a liquid refrigerant. The expansion valve 16*e* is disposed between the gas-liquid separator 14 and the refrigerant pipe 4 that connects the expansion valve 16*a* and the expansion valve 16*b* and is configured to function as a pressure reducing valve or an expansion device so as to reduce the pressure of the heat source side refrigerant such that the refrigerant is expanded. The expansion valve 16*e* may be a component having a variably controllable opening degree, for example, an electronic expansion valve.

The two intermediate heat exchangers 15 (the first intermediate heat exchanger 15*a* and the second intermediate heat exchanger 15*b*) are configured to function as a heating device (condenser) or a cooling device (cooler), exchange heat between the heat source side refrigerant and the heat medium, and supply cooling energy or heating energy produced by the heat source unit 1 to the indoor units 2. The first intermediate heat exchanger 15*a* is disposed between the gas-liquid separator 14 and the expansion valve 16*d* in the flow direction of the heat source side refrigerant and is used to heat the heat medium. The second intermediate heat exchanger 15*b* is disposed between the expansion valves 16*a* and 16*c* in the flow direction of the heat source side refrigerant and is used to cool the heat medium.

The four expansion valves 16 (expansion valves 16*a* to 16*d*) are configured to function as a pressure reducing valve or an expansion device and reduce the pressure of the heat source side refrigerant such that the refrigerant is expanded. The expansion valve 16*a* is disposed between the expansion valve 16*e* and the second intermediate heat exchanger 15*b*. The expansion valve 16*b* is disposed in parallel to the expansion valve 16*a*. The expansion valve 16*c* is disposed between the second intermediate heat exchanger 15*b* and the first relay unit 3*a*. The expansion valve 16*d* is disposed between the first intermediate heat exchanger 15*a* and the expansion valves 16*a* and 16*b*. Each of the four expansion valves 16 may be a component having a variably controllable opening degree, for example, an electronic expansion valve.

The two pumps 21 (a first pump 21*a* and a second pump 21*b*) are configured to circulate the heat medium conveyed through the pipe 5. The first pump 21*a* is provided to the pipe 5 between the first intermediate heat exchanger 15*a* and the flow switching valves 22. The second pump 21*b* is provided to the pipe 5 between the second intermediate heat exchanger 15*b* and the flow switching valves 22. Each of the first pump 21*a* and the second pump 21*b* may be of any type, for example, a capacity-controllable pump.

Each of the four flow switching valves 22 (flow switching valves 22*a* to 22*d*) is a three-way valve and is configured to switch between passages for the heat medium. The flow switching valves 22 which are equal in number to the (four in this case) indoor units 2 installed are arranged. Each flow switching valve 22 is disposed on an inlet side of a heat medium passage of the corresponding use side heat exchanger 26 such that one of three ways is connected to the first intermediate heat exchanger 15*a*, another one of the three ways is connected to the second intermediate heat exchanger 15*b*, and the other one of the three ways is connected to the stop valve 24. Note that the flow switching valve 22*a*, the flow switching valve 22*b*, the flow switching valve 22*c*, and the flow switching valve 22*d* are illustrated in that order from the bottom of the drawing sheet so as to correspond to the respective indoor units 2.

Each of the four flow switching valves 23 (flow switching valves 23*a* to 23*d*) is a three-way valve and is configured to switch between passages for the heat medium. The flow switching valves 23 which are equal in number to the (four in this case) indoor units 2 installed are arranged. Each flow switching valve 23 is disposed on an outlet side of the heat medium passage of the corresponding use side heat exchanger 26 such that one of three ways is connected to the first intermediate heat exchanger 15*a*, another one of the three ways is connected to the second intermediate heat exchanger 15*b*, and the other one of the three ways is connected to the flow control valve 25. Note that the flow switching valve 23*a*, the flow switching valve 23*b*, the flow switching valve 23*c*, and the flow switching valve 23*d* are illustrated in that order from the bottom of the drawing sheet so as to correspond to the respective indoor units 2.

Each of the four stop valves 24 (stop valves 24*a* to 24*d*) is a two-way valve and is configured to open or close the pipe 5. The stop valves 24 which are equal in number to the (four in this case) indoor units 2 installed are arranged. Each stop valve 24 is disposed on the inlet side of the heat medium passage of the corresponding use side heat exchanger 26 such that one of two ways is connected to the use side heat exchanger 26 and the other one of the two ways is connected to the flow switching valve 22. Note that the stop valve 24*a*, the stop valve 24*b*, the stop valve 24*c*, and the stop valve 24*d* are illustrated in that order from the bottom of the drawing sheet so as to correspond to the respective indoor units 2.

Each of the four flow control valves 25 (flow control valves 25*a* to 25*d*) is a three-way valve and is configured to switch between passages for the heat medium. The flow control valves 25 which are equal in number to the (four in this case) indoor units 2 installed are arranged. Each flow control valve 25 is disposed on the outlet side of the heat medium passage of the corresponding use side heat exchanger 26 such that one of three ways is connected to the use side heat exchanger 26, another one of the three ways is connected to a bypass 27, and the other one of the three ways is connected to the flow switching valve 23. Note that the flow control valve 25*a*, the flow control valve 25*b*, the flow control valve 25*c*, and the flow control valve 25*d* are illustrated in that order from the bottom of the drawing sheet so as to correspond to the respective indoor units 2.

Each bypass 27 is disposed so as to connect the flow control valve 25 and the pipe 5 between the stop valve 24 and the use side heat exchanger 26. The bypasses 27 which are equal in number to the (four in this case) indoor units 2 installed, specifically, a bypass 27*a*, a bypass 27*b*, a bypass 27*c*, and a bypass 27*d* are arranged. Note that the bypass 27*a*, the bypass 27*b*, the bypass 27*c*, and the bypass 27*d* are illustrated in that order from the bottom of the drawing sheet so as to correspond to the respective indoor units 2.

The second relay unit 3*b* further includes two first temperature sensors 31, two second temperature sensors 32, four third temperature sensors 33, four fourth temperature sensors 34, a fifth temperature sensor 35, a pressure sensor 36, a sixth temperature sensor 37, and a seventh temperature sensor 38. Furthermore, each indoor unit includes an eighth temperature sensor 39. Signals indicating physical quantities detected by such detecting devices are transmitted to a controller 60 that controls an operation of the air-conditioning apparatus 100 which will be described later. The signals are used to control, for example, a driving frequency of each pump 21 and switching between passages for the heat medium flowing through the pipes 5.

The first temperature sensors 31 (a first temperature sensor 31*a* and a first temperature sensor 31*b*), serving as outgoing heat medium temperature detecting devices, each detect the temperature of the heat medium on an outlet side of a heat medium passage of the corresponding intermediate heat exchanger 15. The first temperature sensor 31*a* is provided to the pipe 5 on an inlet side of the first pump 21*a*. The first temperature sensor 31*b* is provided to the pipe 5 on an inlet side of the second pump 21*b*.

The second temperature sensors 32 (a second temperature sensor 32*a* and a second temperature sensor 32*b*), serving as incoming heat medium temperature detecting devices, each detect the temperature of the heat medium on an inlet side of the heat medium passage of the corresponding intermediate heat exchanger 15. The second temperature sensor 32*a* is provided to the pipe 5 on the inlet side of the heat medium passage of the first intermediate heat exchanger 15*a*. The second temperature sensor 32*b* is provided to the pipe 5 on the inlet side of the heat medium passage of the second intermediate heat exchanger 15*b*.

Each of the third temperature sensors 33 (third temperature sensors 33*a* to 33*d*), serving as use-side incoming temperature detecting devices, is disposed on the inlet side of the heat medium passage of the use side heat exchanger 26 in the corresponding indoor unit 2 and detects the temperature of the heat medium flowing into the use side heat exchanger 26. In FIG. 3, the third temperature sensor 33*a*, the third temperature sensor 33*b*, the third temperature sensor 33*c*, and the third temperature sensor 33*d* are illustrated in that order from the bottom of the drawing sheet so as to correspond to the indoor units 2*a* to 2*d*, respectively.

Each of the fourth temperature sensors 34 (fourth temperature sensors 34*a* to 34*d*), serving as use-side outgoing temperature detecting devices, is disposed on the outlet side of the heat medium passage of the use side heat exchanger 26 in the corresponding indoor unit 2 and detects the temperature of the heat medium flowing out of the use side heat exchanger 26. In FIG. 3, the fourth temperature sensor 34*a*, the fourth temperature sensor 34*b*, the fourth temperature sensor 34*c*, and the fourth temperature sensor 34*d* are illustrated in that order from the bottom of the drawing sheet so as to correspond to the indoor units 2*a* to 2*d*, respectively.

The fifth temperature sensor 35 is disposed on an outlet side of a heat source side refrigerant passage of the first intermediate heat exchanger 15*a* and is configured to detect the temperature of the heat source side refrigerant flowing out of the first intermediate heat exchanger 15*a*. The pressure sensor 36 is disposed on the outlet side of the heat source side refrigerant passage of the first intermediate heat exchanger 15*a* and is configured to detect the pressure of the heat source side refrigerant flowing out of the first intermediate heat exchanger 15*a*.

The sixth temperature sensor 37 is disposed on an inlet side of a heat source side refrigerant passage of the second intermediate heat exchanger 15*b* and is configured to detect the temperature of the heat source side refrigerant flowing into the second intermediate heat exchanger 15*b*. The seventh temperature sensor 38 is disposed on an outlet side of the heat source side refrigerant passage of the second intermediate heat exchanger 15*b* and is configured to detect the temperature of the heat source side refrigerant flowing out of the second intermediate heat exchanger 15*b*.

The eighth temperature sensors 39 (eighth temperature sensors 39*a* to 39*d*), serving as air-conditioning target temperature detecting devices, each detect the temperature (indoor temperature) of air to be conditioned. In this case, each eighth temperature sensor 39 detects the temperature (sucked air temperature) of air allowed to flow into the use side heat exchanger 26 by driving of the indoor fan 28 in the corresponding indoor unit 2. In FIG. 3, the eighth temperature sensor 39*a*, the eighth temperature sensor 39*b*, the eighth temperature sensor 39*c*, and the eighth temperature sensor 39*d* are illustrated in that order from the bottom of the drawing sheet so as to correspond to the indoor units 2*a* to 2*d*, respectively. A ninth temperature sensor 40, serving as an outdoor air temperature detecting device, is provided for, for example, the heat source unit 1 and detects the temperature (outdoor air temperature) of outdoor air. Each of the above-described temperature sensors may be a thermistor or the like.

The pipes 5 through which the heat medium is conveyed include the pipes 5 (hereinafter, referred to as "pipes 5*a*") connected to the first intermediate heat exchanger 15*a* and the pipes 5 (hereinafter, referred to as "pipes 5*b*") connected to the second intermediate heat exchanger 15*b*. Each of the pipes 5*a* and 5*b* branches into pipes (four pipes in this case) equal in number to the indoor units 2 connected to the relay unit 3. The pipes 5*a* and the pipes 5*b* are connected by the flow switching valves 22, the flow switching valves 23, and the flow control valves 25. Whether the heat medium conveyed through the pipe 5*a* is allowed to flow into the use side heat exchanger 26 or the heat medium conveyed through the pipe 5*b* is allowed to flow into the use side heat exchanger 26 is determined by controlling the corresponding flow switching valves 22 and 23.

The air-conditioning apparatus 100 further includes the controller 60 that controls operations of the components arranged in the heat source unit 1, the relay unit 3, and the indoor units 2 on the basis of information from a remote control for receiving instructions from various detecting means and a user. The controller 60 controls, for example, a driving frequency of the compressor 10 disposed in the heat source unit 1, a rotation speed (including ON/OFF) of the air-sending device disposed near the heat source side heat exchanger 12, and switching of the four-way valve 11 to perform any of operation modes, which will be described later. Furthermore, the controller 60 controls a rotation speed (including ON/OFF) of the indoor fan 28 disposed near the use side heat exchanger 26 included in each indoor unit 2.

In addition, the controller 60 controls driving of the pumps 21 arranged in the relay unit 3, opening degrees of the expansion valves 16*a* to 16*e*, switching of the flow switching valves 22 and the flow switching valves 23, opening and closing of the stop valves 24, and switching of the flow control valves 25. Specifically, the controller 60 has functions of flow control means for controlling the flow rate of the heat medium in the relay unit 3, functions of passage determining means for determining a heat medium passage, functions of ON/OFF control means for turning each component on or off, and functions of control target value changing means for appropriately changing a set target value on the basis of information from the various detecting means. In particular, according to Embodiment 1, the controller 60 performs a process of determining an abnormal flow rate of the heat medium in the heat medium circuits to protect the pumps 21. The controller 60 includes a microcomputer. The controller 60 further includes a timer 61, serving as a time measuring device, and is accordingly capable of measuring time. The controller 60 further includes a storage unit (not illustrated) for storing data or the like. The controller may be provided for each unit. In such a case, the controllers may preferably be enabled to communicate with each other.

The air-conditioning apparatus 100 according to Embodiment 1 further includes an annunciator 62. The annunciator 62 includes a display unit, an audio output unit, or the like to provide information with text displayed, audio output, or the like. The annunciator 62 may be included in, for example, the remote control. In Embodiment 1, when any of the pumps 21 is stopped due to, for example, abnormality in flow rate of the heat medium, the annunciator 62 provides information about such a state.

In the air-conditioning apparatus 100, the compressor 10, the four-way valve 11, the heat source side heat exchanger 12, the refrigerant passage of the first intermediate heat exchanger 15*a*, the refrigerant passage of the second intermediate heat exchanger 15*b*, and the accumulator 17 are connected by the refrigerant pipes 4 through which the refrigerant flows, thus providing the refrigeration cycle. In addition, the heat medium passage of the first intermediate heat exchanger 15*a*, the first pump 21*a*, and each use side heat exchanger 26 are sequentially connected in series by the pipes 5*a* through which the heat medium flows, thus providing a heat medium circuit for heating. Similarly, the heat medium passage of the second intermediate heat exchanger 15*b*, the second pump 21*b*, and each use side heat exchanger 26 are sequentially connected in series by the pipes 5*b* through which the heat medium flows, thus providing a heat medium circuit for cooling. Specifically, a plurality of use side heat exchangers 26 are connected in parallel with to one another each intermediate heat exchanger 15, thus providing a plurality of heat medium circuits, or heat medium systems. A heat medium circuit for heating is provided with a discharge valve 71*a* provided to the pipe 5*a* and the discharge valve 71*a* is configured to discharge the heat medium from this heat medium circuit. A heat medium circuit for cooling is provided with a discharge valve 71*b* provided to the pipe 5*b* and the discharge valve 71*b* is configured to discharge the heat medium from this heat medium circuit.

Specifically, in the air-conditioning apparatus 100, the heat source unit 1 is connected to the relay unit 3 through the first intermediate heat exchanger 15*a* and the second intermediate heat exchanger 15*b* arranged in the relay unit 3, and the relay unit 3 is connected to the indoor units 2 through the first intermediate heat exchanger 15*a* and the second intermediate heat exchanger 15*b*. The first intermediate heat exchanger 15*a* and the second intermediate heat exchanger 15*b* allow the heat source side refrigerant, serving as a primary refrigerant, circulated through the refrigeration cycle to exchange heat with the heat medium, serving as a secondary refrigerant, circulated through the heat medium circuits.

The kinds of refrigerant used in the refrigeration cycle and the heat medium circuits will now be described. In the refrigeration cycle, a non-azeotropic refrigerant mixture, such as R407C, a near-azeotropic refrigerant mixture, such as R410A or R404A, or a single refrigerant, such as R22 or R134a, can be used. Alternatively, a natural refrigerant, such as carbon dioxide or hydrocarbon, may be used. The use of the natural refrigerant as the heat source side refrigerant can reduce the Earth's greenhouse effect caused by refrigerant leakage. In particular, the use of carbon dioxide can improve heat exchange performance for heating or cooling the heat medium in the arrangement in which the heat source side refrigerant and the heat medium are allowed to flow in a counter-current manner in the first intermediate heat exchanger 15*a* and the second intermediate heat exchanger 15*b* as illustrated in FIGS. 4-7, because carbon dioxide in a supercritical state on a high-pressure side exchanges heat without condensing.

As described above, the heat medium circuits are connected to the use side heat exchangers 26 in the indoor units 2. Accordingly, the air-conditioning apparatus 100 is premised on the use of a highly safe heat medium in consideration of the leakage of the heat medium into a room or the like in which the indoor unit 2 is installed. As regards the heat medium, therefore, water, antifreeze, a liquid mixture of water and antifreeze, or the like can be used. A highly heat insulating fluorine inert liquid can be used as the heat medium in consideration of the installation of the indoor unit 2 in a place that dislikes moisture, for example, a computer room. If the heat source side refrigerant leaks from any refrigerant pipe 4, therefore, the leaked heat source side refrigerant can be prevented from entering an indoor space, thus providing high reliability.

<Operation Modes of Air-Conditioning Apparatus 100>

The operation modes performed by the air-conditioning apparatus 100 will now be described.

The air-conditioning apparatus 100 enables each indoor unit 2, on the basis of an instruction from the indoor unit 2, to perform the cooling operation or the heating operation. More specifically, the air-conditioning apparatus 100 enables all of the indoor units 2 to perform the same operation and also enables the indoor units 2 to perform different operations. In other words, the air-conditioning apparatus 100 according to Embodiment 1 is an air-conditioning apparatus capable of performing the cooling operation and the heating operation at the same time. Four operation modes performed by the air-conditioning apparatus 100, that is, a cooling only operation mode in which all of the operating indoor units 2 perform the cooling operation, a heating only operation mode in which all of the operating indoor units 2 perform the heating operation, a cooling main operation mode in which a cooling load is the larger, and a heating main operation mode in which a heating load is the larger will be described below in accordance with the flows of the refrigerants. For the sake of convenience, some of the temperature sensors and other components are not illustrated in FIGS. 4 to 7 for explaining the operation modes.

(Cooling Only Operation Mode)

Figure 4:
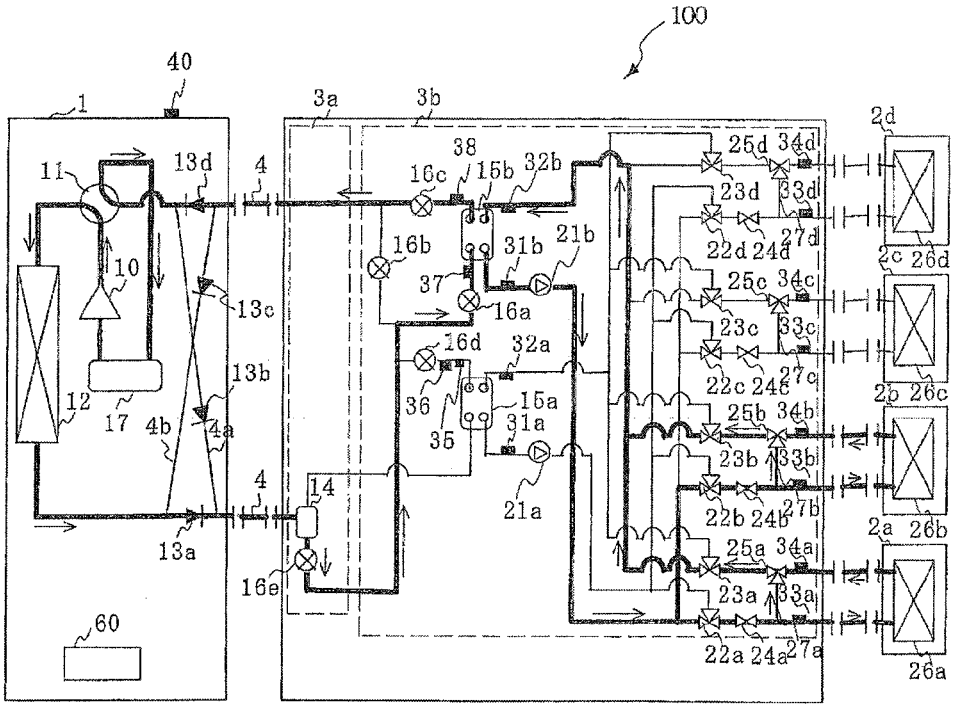
FIG. 4 is a refrigerant circuit diagram illustrating the flows of refrigerants in a cooling only operation mode of the air-conditioning apparatus according to Embodiment 1.

FIG. 4 is a refrigerant circuit diagram illustrating the flows of the refrigerants in the cooling only operation mode of the air-conditioning apparatus 100. The cooling only operation mode will be described on the assumption that, for example, a cooling energy load is generated only in the use side heat exchangers 26*a* and 26*b* in FIG. 4. In other words, FIG. 4 illustrates a case where no cooling energy load is generated in the use side heat exchangers 26*c* and 26*d*. In FIG. 4, pipes indicated by thick lines correspond to pipes through which the refrigerants (the heat source side refrigerant and the heat medium) are circulated. Furthermore, solid-line arrows indicate the direction of flow of the heat source side refrigerant and that of the heat medium.

In the cooling only operation mode illustrated in FIG. 4, in the heat source unit 1, the four-way valve 11 is switched such that the heat source side refrigerant discharged from the compressor 10 flows into the heat source side heat exchanger 12. In the relay unit 3, the first pump 21*a* is stopped, the second pump 21*b* is driven, the stop valves 24*a* and 24*b* are opened, and the stop valves 24*c* and 24*d* are closed such that the heat medium is circulated between the second intermediate heat exchanger 15*b* and the use side heat exchangers (the use side heat exchangers 26*a* and 26*b*). In this state, the operation of the compressor 10 is started.

First, the flow of the heat source side refrigerant in the refrigeration cycle will be described.

A low-temperature low-pressure refrigerant is compressed into a high-temperature high-pressure gas refrigerant by the compressor 10 and the resultant refrigerant is discharged therefrom. The high-temperature high-pressure gas refrigerant discharged from the compressor 10 passes through the four-way valve 11 and flows into the heat source side heat exchanger 12. In the heat source side heat exchanger 12, the refrigerant condenses and liquefies while transferring heat to outdoor air, so that the refrigerant turns into a high-pressure liquid refrigerant. The high-pressure liquid refrigerant, which has flowed out of the heat source side heat exchanger 12, passes through the check valve 13*a*, flows out of the heat source unit 1, passes through the refrigerant pipe 4, and flows into the first relay unit 3*a*. The high-pressure liquid refrigerant, which has flowed into the first relay unit 3*a*, flows into the gas-liquid separator 14, passes through the expansion valve 16*e*, and then flows into the second relay unit 3*b*.

The refrigerant, which has flowed into the second relay unit 3*b*, is throttled by the expansion valve 16*a*, so that the refrigerant expands into a low-temperature, low-pressure two-phase gas-liquid refrigerant. The two-phase gas-liquid refrigerant flows into the second intermediate heat exchanger 15*b*, serving as an evaporator, removes heat from the heat medium circulated through the heat medium circuits, so that the refrigerant turns into a low-temperature low-pressure gas refrigerant while cooling the heat medium. The gas refrigerant, which has flowed out of the second intermediate heat exchanger 15*b*, passes through the expansion valve 16*c*, flows out of the second relay unit 3*b* and the first relay unit 3*a*, passes through the refrigerant pipe 4, and flows into the heat source unit 1. The refrigerant, which has flowed into the heat source unit 1, passes through the check valve 13*d*, the four-way valve 11, and the accumulator 17, and is then again sucked into the compressor 10. The expansion valves 16*b* and 16*d* are allowed to have such a small opening degree that the refrigerant does not flow through the valve and the expansion valve 16*c* is fully opened in order to prevent pressure loss.

Next, the flow of the heat medium in the heat medium circuits will be described.

In the cooling only operation mode, the first pump 21*a* is stopped and the heat medium is accordingly circulated through the pipes 5*b*. The second pump 21*b* allows the heat medium cooled by the heat source side refrigerant in the second intermediate heat exchanger 15*b* to flow through the pipes 5*b*. The heat medium, pressurized by the second pump 21*b*, leaving the second pump 21*b* passes through the flow switching valves 22 (the flow switching valve 22*a* and the flow switching valve 22*b*) and the stop valves 24 (the stop valve 24*a* and the stop valve 24*b*) and flows into the use side heat exchangers 26 (the use side heat exchanger 26*a* and the use side heat exchanger 26*b*). In each use side heat exchanger 26, the heat medium removes heat from indoor air to cool the air-conditioning target area, such as an indoor space, where the indoor unit 2 is installed.

After that, the heat medium flows out of the use side heat exchangers 26 and flows into the flow control valves 25 (the flow control valve 25*a* and the flow control valve 25*b*). At this time, each flow control valve 25 allows only the amount of heat medium required to compensate for an air conditioning load needed in the air-conditioning target area, such as an indoor space, to flow into the corresponding use side heat exchanger 26. The other heat medium flows through each of the bypasses 27 (the bypass 27*a* and the bypass 27*b*) so as to bypass the use side heat exchanger 26.

The heat medium passing through each bypass 27 does not contribute to heat exchange and merges with the heat medium leaving the corresponding use side heat exchanger 26. The resultant heat medium passes through the corresponding flow switching valve 23 (the flow switching valve 23*a* or the flow switching valve 23*b*) and flows into the second intermediate heat exchanger 15*b* and is then again sucked into the second pump 21*b*. Note that the air conditioning load needed in each air-conditioning target area, such as an indoor space, can be provided by controlling the difference between a temperature detected by the third temperature sensor 33 and a temperature detected by the fourth temperature sensor 34 at a target value.

In this case, it is unnecessary to supply the heat medium to each use side heat exchanger 26 having no thermal load (including thermo-off). Accordingly, the corresponding stop valve 24 is closed to block the passage such that the heat medium does not flow into the use side heat exchanger 26. In FIG. 4, the heat medium flows into the use side heat exchanger 26*a* and the use side heat exchanger 26*b* because these heat exchangers each have a thermal load. The use side heat exchanger 26*c* and the use side heat exchanger 26*d* have no thermal load and the corresponding stop valves 24*c* and 24*d* are closed. When a cooling energy load is generated in the use side heat exchanger 26*c* or the use side heat exchanger 26*d*, the stop valve 24*c* or the stop valve 24*d* may be opened such that the heat medium is circulated.

(Heating Only Operation Mode)

Figure 5:
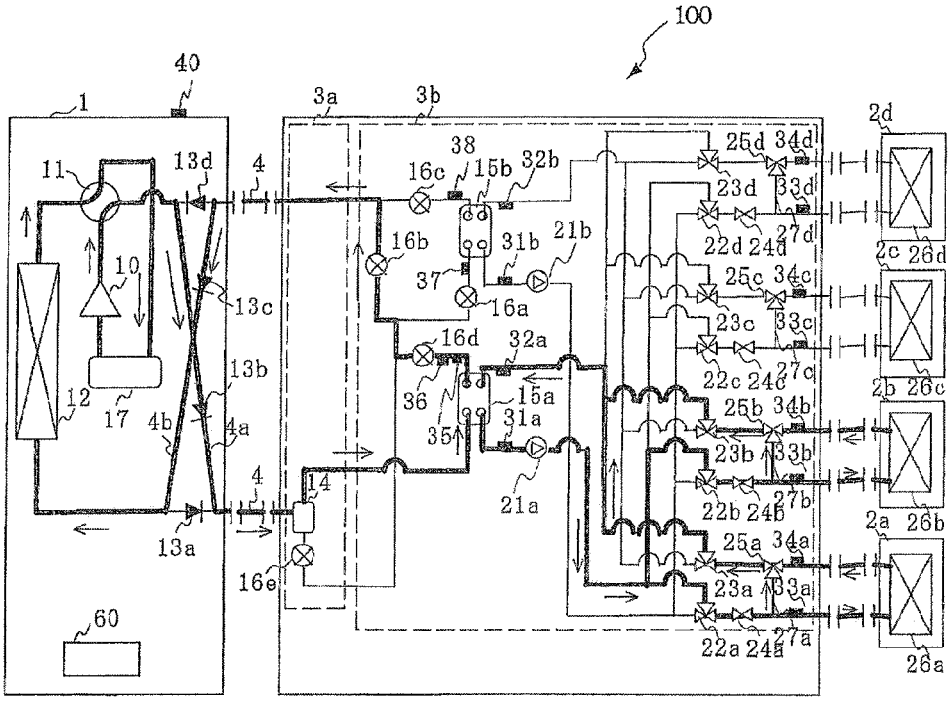
FIG. 5 is a refrigerant circuit diagram illustrating the flows of the refrigerants in a heating only operation mode of the air-conditioning apparatus according to Embodiment 1.

FIG. 5 is a refrigerant circuit diagram illustrating the flows of the refrigerants in the heating only operation mode of the air-conditioning apparatus 100. The heating only operation mode will be described on the assumption that, for example, a heating energy load is generated only in the use side heat exchangers 26*a* and 26*b* in FIG. 5. In other words, FIG. 5 illustrates a case where no heating energy load is generated in the use side heat exchangers 26*c* and 26*d*. In FIG. 5, pipes indicated by thick lines correspond to pipes through which the refrigerants (the heat source side refrigerant and the heat medium) are circulated. Furthermore, solid-line arrows indicate the direction of flow of the heat source side refrigerant and that of the heat medium.

In the heating only operation mode illustrated in FIG. 5, in the heat source unit 1, the four-way valve 11 is switched such that the heat source side refrigerant discharged from the compressor 10 flows into the relay unit 3 without passing through the heat source side heat exchanger 12. In the relay unit 3, the first pump 21*a* is driven, the second pump 21*b* is stopped, the stop valves 24*a* and 24*b* are opened, and the stop valves 24*c* and 24*d* are closed to switch between the heat medium flow directions such that the heat medium is circulated between the first intermediate heat exchanger 15*a* and the use side heat exchangers 26 (the use side heat exchanger 26*a* and the use side heat exchanger 26*b*). In this state, the operation of the compressor 10 is started.

First, the flow of the heat source side refrigerant in the refrigeration cycle will be described.

A low-temperature low-pressure refrigerant is compressed into a high-temperature high-pressure gas refrigerant by the compressor 10 and the resultant refrigerant is discharged therefrom. The high-temperature high-pressure gas refrigerant discharged from the compressor 10 passes through the four-way valve 11, flows through the first connecting pipe 4*a*, passes through the check valve 13*b*, and flows out of the heat source unit 1. The high-temperature high-pressure gas refrigerant, which has flowed out of the heat source unit 1, passes through the refrigerant pipe 4 and flows into the first relay unit 3*a*. The high-temperature high-pressure gas refrigerant, which has flowed into the first relay unit 3*a*, flows into the gas-liquid separator 14 and then flows into the first intermediate heat exchanger 15*a*. The high-temperature high-pressure gas refrigerant, which has flowed into the first intermediate heat exchanger 15*a*, condenses and liquefies while transferring heat to the heat medium circulated through the heat medium circuits, so that the refrigerant turns into a high-pressure liquid refrigerant.

The high-pressure liquid refrigerant leaving the first intermediate heat exchanger 15*a* is throttled by the expansion valve 16*d*, so that the refrigerant expands into a low-temperature, low-pressure two-phase gas-liquid state. The refrigerant in the two-phase gas-liquid state, obtained by throttling through the expansion valve 16*d*, passes through the expansion valve 16*b*, flows through the refrigerant pipe 4, and then flows into the heat source unit 1. The refrigerant, which has flowed into the heat source unit 1, passes through the check valve 13*c* and the second connecting pipe 4*b* and then flows into the heat source side heat exchanger 12, serving as an evaporator. The refrigerant, which has flowed into the heat source side heat exchanger 12, removes heat from the outdoor air in the heat source side heat exchanger 12, so that the refrigerant turns into a low-temperature low-pressure gas refrigerant. The low-temperature low-pressure gas refrigerant leaving the heat source side heat exchanger 12 passes through the four-way valve 11 and the accumulator 17 and then returns to the compressor 10. The expansion valve 16*a*, the expansion valve 16*c*, and the expansion valve 16*e* are allowed to have such a small opening degree that the refrigerant does not flow through the valve.

Next, the flow of the heat medium in the heat medium circuits will be described.

In the heating only operation mode, the second pump 21*b* is stopped and the heat medium is accordingly circulated through the pipes 5*a*. The first pump 21*a* allows the heat medium heated by the heat source side refrigerant in the first intermediate heat exchanger 15*a* to flow through the pipes 5*a*. The heat medium, pressurized by the first pump 21*a*, leaving the first pump 21*a* passes through the flow switching valves 22 (the flow switching valve 22*a* and the flow switching valve 22*b*) and the stop valves 24 (the stop valve 24*a* and the stop valve 24*b*) and flows into the use side heat exchangers 26 (the use side heat exchanger 26*a* and the use side heat exchanger 26*b*). In each use side heat exchanger 26, the heat medium transfers heat to the indoor air to heat the air-conditioning target area, such as an indoor space, where the indoor unit 2 is installed.

After that, the heat medium flows out of the use side heat exchangers 26 and flows into the flow control valves 25 (the flow control valve 25*a* and the flow control valve 25*b*). At this time, each flow control valve 25 allows only the amount of heat medium required to compensate for an air conditioning load needed in the air-conditioning target area, such as an indoor space, to flow into the corresponding use side heat exchanger 26. The other heat medium flows through each of the bypasses 27 (the bypass 27*a* and the bypass 27*b*) so as to bypass the use side heat exchanger 26.

The heat medium passing through each bypass 27 does not contribute to heat exchange and merges with the heat medium leaving the corresponding use side heat exchanger 26. The resultant heat medium passes through the corresponding flow switching valve 23 (the flow switching valve 23*a* or the flow switching valve 23*b*) and flows into the first intermediate heat exchanger 15*a* and is then again sucked into the first pump 21*a*. Note that the air conditioning load needed in each air-conditioning target area, such as an indoor space, can be provided by controlling the difference between a temperature detected by the third temperature sensor 33 and a temperature detected by the fourth temperature sensor 34 at a target value.

In this case, it is unnecessary to supply the heat medium to each use side heat exchanger 26 having no thermal load (including thermo-off). Accordingly, the corresponding stop valve 24 is closed to block the passage such that the heat medium does not flow into the use side heat exchanger 26. In FIG. 5, the heat medium flows into the use side heat exchanger 26*a* and the use side heat exchanger 26*b* because these heat exchangers each have a thermal load. The use side heat exchanger 26*c* and the use side heat exchanger 26*d* have no thermal load and the corresponding stop valves 24*c* and 24*d* are closed. When a heating energy load is generated in the use side heat exchanger 26*c* or the use side heat exchanger 26*d*, the stop valve 24*c* or the stop valve 24*d* may be opened such that the heat medium is circulated.

(Cooling Main Operation Mode)

Figure 6:
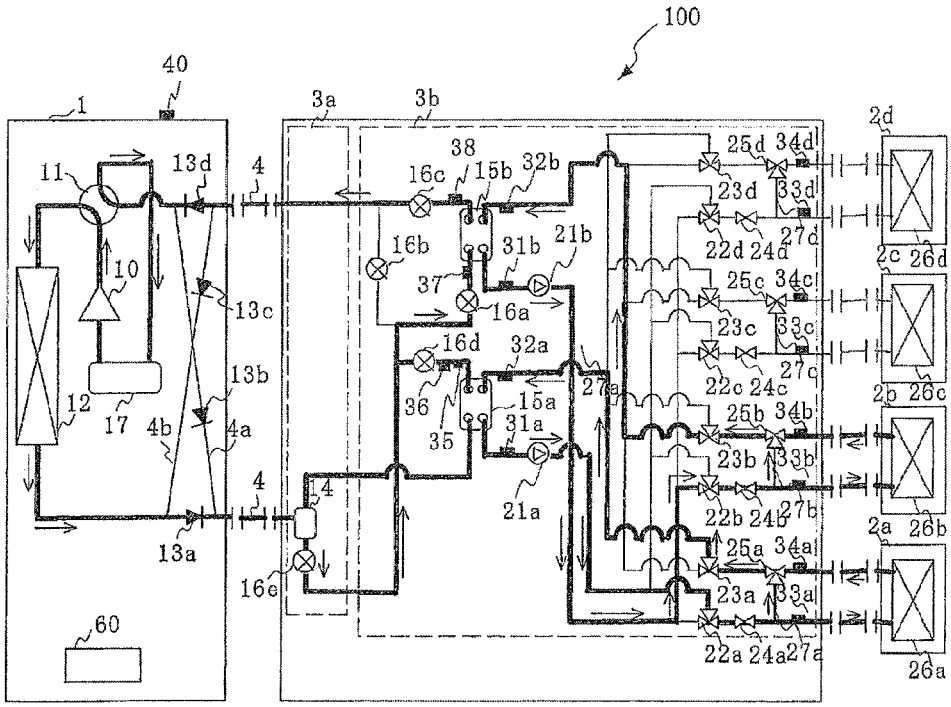
FIG. 6 is a refrigerant circuit diagram illustrating the flows of the refrigerants in a cooling main operation mode of the air-conditioning apparatus according to Embodiment 1.

FIG. 6 is a refrigerant circuit diagram illustrating the flows of the refrigerants in the cooling main operation mode of the air-conditioning apparatus 100. The cooling main operation mode will be described on the assumption that, for example, a heating energy load is generated in the use side heat exchanger 26*a* and a cooling energy load is generated in the use side heat exchanger 26*b* in FIG. 6. In other words, FIG. 6 illustrates a case where neither heating energy load nor cooling energy load is generated in the use side heat exchangers 26*c* and 26*d*. In FIG. 6, pipes indicated by thick lines correspond to pipes through which the refrigerants (the heat source side refrigerant and the heat medium) are circulated. Furthermore, solid-line arrows indicate the direction of flow of the heat source side refrigerant and that of the heat medium.

In the cooling main operation mode illustrated in FIG. 6, in the heat source unit 1, the four-way valve 11 is switched such that the heat source side refrigerant discharged from the compressor 10 flows into the heat source side heat exchanger 12. In the relay unit 3, the first pump 21*a* and the second pump 21*b* are driven, the stop valves 24*a* and 24*b* are opened, and the stop valves 24*c* and 24*d* are closed such that the heat medium is circulated between the first intermediate heat exchanger 15*a* and the use side heat exchanger 26*a* and the heat medium is circulated between the second intermediate heat exchanger 15*b* and the use side heat exchanger 26*b*. In this state, the operation of the compressor 10 is started.

First, the flow of the heat source side refrigerant in the refrigeration cycle will be described.

A low-temperature low-pressure refrigerant is compressed into a high-temperature high-pressure gas refrigerant by the compressor 10 and the resultant refrigerant is discharged therefrom. The high-temperature high-pressure gas refrigerant discharged from the compressor 10 passes through the four-way valve 11 and flows into the heat source side heat exchanger 12. In the heat source side heat exchanger 12, the refrigerant condenses while transferring heat to the outdoor air, so that the refrigerant turns into a two-phase gas-liquid refrigerant. The two-phase gas-liquid refrigerant, which has flowed out of the heat source side heat exchanger 12, passes through the check valve 13*a*, flows out of the heat source unit 1, passes through the refrigerant pipe 4, and flows into the first relay unit 3*a*. The two-phase gas-liquid refrigerant, which has flowed into the first relay unit 3*a*, flows into the gas-liquid separator 14, where the refrigerant is separated into a gas refrigerant and a liquid refrigerant. The resultant refrigerants flow into the second relay unit 3*b*.

The gas refrigerant, obtained by separation through the gas-liquid separator 14, flows into the first intermediate heat exchanger 15*a*. The gas refrigerant, which has flowed into the first intermediate heat exchanger 15*a*, condenses and liquefies while transferring heat to the heat medium circulated through the heat medium circuit, so that the refrigerant turns into a liquid refrigerant. The liquid refrigerant, which has flowed out of the first intermediate heat exchanger 15*a*, passes through the expansion valve 16*d*. On the other hand, the liquid refrigerant, obtained by separation through the gas-liquid separator 14, passes through the expansion valve 16*e* and merges with the liquid refrigerant leaving the expansion valve 16*d* after condensation and liquefaction in the first intermediate heat exchanger 15*a*. The resultant refrigerant is throttled by the expansion valve 16*a*, so that the refrigerant expands into a low-temperature, low-pressure two-phase gas-liquid refrigerant. The refrigerant flows into the second intermediate heat exchanger 15*b*.

The two-phase gas-liquid refrigerant removes heat from the heat medium circulated through the heat medium circuit in the second intermediate heat exchanger 15*b*, serving as an evaporator, so that the refrigerant turns into a low-temperature low-pressure gas refrigerant while cooling the heat medium. The gas refrigerant, which has flowed out of the second intermediate heat exchanger 15*b*, passes through the expansion valve 16*c*, flows out of the second relay unit 3*b* and the first relay unit 3*a*, passes through the refrigerant pipe 4, and flows into the heat source unit 1. The refrigerant, which has flowed into the heat source unit 1, passes through the check valve 13*d*, the four-way valve 11, and the accumulator 17, and is then again sucked into the compressor 10. The expansion valve 16*b* is allowed to have such a small opening degree that the refrigerant does not flow through the valve and the expansion valve 16*c* is fully opened in order to prevent pressure loss.

Next, the flow of the heat medium in the heat medium circuits will be described.

In the cooling main operation mode, both the first pump 21*a* and the second pump 21*b* are driven and the heat medium is accordingly circulated through the pipes 5*a* and 5*b*. The first pump 21*a* allows the heat medium heated by the heat source side refrigerant in the first intermediate heat exchanger 15*a* to flow through the pipes 5*a*. The second pump 21*b* allows the heat medium cooled by the heat source side refrigerant in the second intermediate heat exchanger 15*b* to flow through the pipes 5*b*.

The heat medium, pressurized by the first pump 21*a*, leaving the first pump 21*a* passes through the flow switching valve 22*a* and the stop valve 24*a*, and then flows into the use side heat exchanger 26*a*. The heat medium transfers heat to the indoor air in the use side heat exchanger 26*a* to heat the air-conditioning target area, such as an indoor space, where the indoor unit 2 is installed. In addition, the heat medium, pressurized by the second pump 21*b*, leaving the second pump 21*b* passes through the flow switching valve 22*b* and the stop valve 24*b*, and then flows into the use side heat exchanger 26*b*. The heat medium removes heat from the indoor air in the use side heat exchanger 26*b* to cool the air-conditioning target area, such as an indoor space, where the indoor unit 2 is installed.

The heat medium, used for heating, flows into the flow control valve 25*a*. At this time, the flow control valve 25*a* allows only the amount of heat medium required to compensate for an air conditioning load needed in the air-conditioning target area to flow into the use side heat exchanger 26*a*. The other heat medium flows through the bypass 27*a* so as to bypass the use side heat exchanger 26*a*. The heat medium passing through the bypass 27*a* does not contribute to heat exchange and merges with the heat medium leaving the use side heat exchanger 26*a*. The resultant heat medium passes through the flow switching valve 23*a* and flows into the first intermediate heat exchanger 15*a* and is then again sucked into the first pump 21*a*.

Similarly, the heat medium, used for cooling, flows into the flow control valve 25*b*. At this time, the flow control valve 25*b* allows only the amount of heat medium required to compensate for an air conditioning load needed in the air-conditioning target area to flow into the use side heat exchanger 26*b*. The other heat medium flows through the bypass 27*b* so as to bypass the use side heat exchanger 26*b*. The heat medium passing through the bypass 27*b* does not contribute to heat exchange and merges with the heat medium leaving the use side heat exchanger 26*b*. The resultant heat medium passes through the flow switching valve 23*b* and flows into the second intermediate heat exchanger 15*b* and is then again sucked into the second pump 21*b*.

Throughout this mode, the flow switching valves 22 (the flow switching valve 22*a* and the flow switching valve 22*b*) and the flow switching valves 23 (the flow switching valve 23*a* and the flow switching valve 23*b*) allow the warm heat medium (the heat medium used for the heating energy load) and the cold heat medium (the heat medium used for the cooling energy load) to flow into the use side heat exchanger 26*a* having the heating energy load and the use side heat exchanger 26*b* having the cooling energy load, respectively, without mixing with each other. Note that the air conditioning load needed in each air-conditioning target area, such as an indoor space, can be provided by controlling the difference between a temperature detected by the third temperature sensor 33 and a temperature detected by the fourth temperature sensor 34 at a target value.

In this case, it is unnecessary to supply the heat medium to each use side heat exchanger 26 having no thermal load (including thermo-off). Accordingly, the corresponding stop valve 24 is closed to block the passage such that the heat medium does not flow into the use side heat exchanger 26. In FIG. 6, the heat medium is allowed to flow into the use side heat exchanger 26*a* and the use side heat exchanger 26*b* because these heat exchangers each have a thermal load. The use side heat exchanger 26*c* and the use side heat exchanger 26*d* have no thermal load and the corresponding stop valves 24*c* and 24*d* are closed. If a heating energy load or a cooling energy load is generated in the use side heat exchanger 26*c* or the use side heat exchanger 26*d*, the stop valve 24*c* or the stop valve 24*d* may be opened such that the heat medium is circulated.

(Heating Main Operation Mode)

Figure 7:
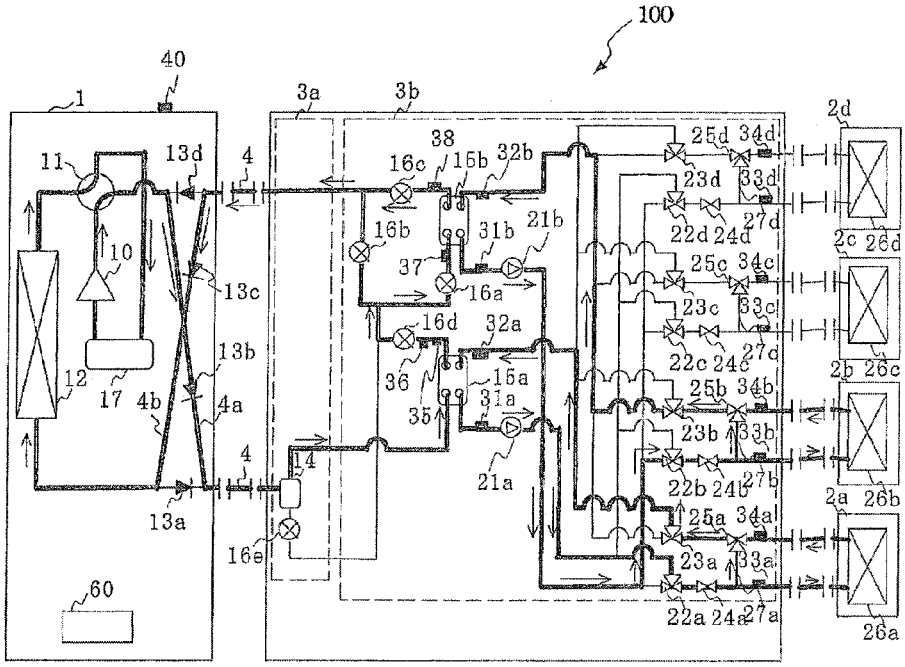
FIG. 7 is a refrigerant circuit diagram illustrating the flows of the refrigerants in a heating main operation mode of the air-conditioning apparatus according to Embodiment 1.

FIG. 7 is a refrigerant circuit diagram illustrating the flows of the refrigerants in the heating main operation mode of the air-conditioning apparatus 100. The heating main operation mode will be described on the assumption that, for example, a heating energy load is generated in the use side heat exchanger 26*a* and a cooling energy load is generated in the use side heat exchanger 26*b* in FIG. 7. In other words, FIG. 7 illustrates a case where neither heating energy load nor cooling energy load is generated in the use side heat exchangers 26*c* and 26*d*. In FIG. 7, pipes indicated by thick lines correspond to pipes through which the refrigerants (the heat source side refrigerant and the heat medium) are circulated. Furthermore, solid-line arrows indicate the direction of flow of the heat source side refrigerant and that of the heat medium.

In the heating main operation mode illustrated in FIG. 7, in the heat source unit 1, the four-way valve 11 is switched such that the heat source side refrigerant discharged from the compressor 10 flows into the relay unit 3 without passing through the heat source side heat exchanger 12. In the relay unit 3, the first pump 21*a* and the second pump 21*b* are driven, the stop valves 24*a* and 24*b* are opened, and the stop valves 24*c* and 24*d* are closed such that the heat medium is circulated between the first intermediate heat exchanger 15*a* and the use side heat exchanger 26*a* and the heat medium is circulated between the second intermediate heat exchanger 15*b* and the use side heat exchanger 26*b*. In this state, the operation of the compressor 10 is started.

First, the flow of the heat source side refrigerant in the refrigeration cycle will be described.

A low-temperature low-pressure refrigerant is compressed into a high-temperature high-pressure gas refrigerant by the compressor 10 and the resultant refrigerant is discharged therefrom. The high-temperature high-pressure gas refrigerant discharged from the compressor 10 passes through the four-way valve 11, flows through the first connecting pipe 4*a*, passes through the check valve 13*b*, and flows out of the heat source unit 1. The high-temperature high-pressure gas refrigerant, which has flowed out of the heat source unit 1, passes through the refrigerant pipe 4 and flows into the first relay unit 3*a*. The high-temperature high-pressure gas refrigerant, which has flowed into the first relay unit 3*a*, flows into the gas-liquid separator 14 and then flows into the first intermediate heat exchanger 15*a*. The high-temperature high-pressure gas refrigerant, which has flowed into the first intermediate heat exchanger 15*a*, condenses and liquefies while transferring heat to the heat medium circulated through the heat medium circuit, so that the refrigerant turns into a high-pressure liquid refrigerant.

The high-pressure liquid refrigerant leaving the first intermediate heat exchanger 15*a* is throttled by the expansion valve 16*d*, so that the refrigerant expands into a low-temperature, low-pressure two-phase gas-liquid state. The refrigerant in the two-phase gas-liquid state, obtained by throttling through the expansion valve 16*d*, is divided into a flow to the expansion valve 16*a* and a flow to the expansion valve 16*b*. As regards the refrigerant flowing through the expansion valve 16*a*, the refrigerant is further expanded by the expansion valve 16*a*, so that the refrigerant turns into a low-temperature, low-pressure two-phase gas-liquid refrigerant. The resultant refrigerant flows into the second intermediate heat exchanger 15*b*, serving as an evaporator. The refrigerant, which has flowed into the second intermediate heat exchanger 15*b*, removes heat from the heat medium in the second intermediate heat exchanger 15*b*, so that the refrigerant turns into a low-temperature low-pressure gas refrigerant. The low-temperature low-pressure gas refrigerant leaving the second intermediate heat exchanger 15*b* passes through the expansion valve 16*c*.

As regards the refrigerant flowing through the expansion valve 16*b* after being throttled through the expansion valve 16*d*, the refrigerant merges with the refrigerant which has passed through the second intermediate heat exchanger 15*b* and the expansion valve 16*c*, so that the low-temperature low-pressure refrigerant exhibits a higher quality. The resultant refrigerant flows out of the second relay unit 3*b* and the first relay unit 3*a*, passes through the refrigerant pipe 4, and flows into the heat source unit 1. The refrigerant, which has flowed into the heat source unit 1, passes through the check valve 13*c* and the second connecting pipe 4*b* and flows into the heat source side heat exchanger 12, serving as an evaporator. The refrigerant, which has flowed into the heat source side heat exchanger 12, removes heat from the outdoor air in the heat source side heat exchanger 12, so that the refrigerant turns into a low-temperature low-pressure gas refrigerant. The low-temperature low-pressure gas refrigerant leaving the heat source side heat exchanger 12 flows through the four-way valve 11 and the accumulator 17 and then returns to the compressor 10. The expansion valve 16*e* is allowed to have such a small opening degree that the refrigerant does not flow through the valve.

Next, the flow of the heat medium in the heat medium circuits will be described.

In the heating main operation mode, both the first pump 21*a* and the second pump 21*b* are driven and the heat medium is accordingly circulated through the pipes 5*a* and 5*b*. The first pump 21*a* allows the heat medium heated by the heat source side refrigerant in the first intermediate heat exchanger 15*a* to flow through the pipes 5*a*. The second pump 21*b* allows the heat medium cooled by the heat source side refrigerant in the second intermediate heat exchanger 15*b* to flow through the pipes 5*b*.

The heat medium, pressurized by the first pump 21*a*, leaving the first pump 21*a* passes through the flow switching valve 22*a* and the stop valve 24*a* and then flows into the use side heat exchanger 26*a*. The heat medium transfers heat to the indoor air in the use side heat exchanger 26*a* to heat the air-conditioning target area, such as an indoor space, where the indoor unit 2 is installed. In addition, the heat medium, pressurized by the second pump 21*b*, leaving the second pump 21*b* passes through the flow switching valve 22*b* and the stop valve 24*b* and then flows into the use side heat exchanger 26*b*. The heat medium removes heat from the indoor air in the use side heat exchanger 26*b* to cool the air-conditioning target area, such as an indoor space, where the indoor unit 2 is installed.

The heat medium leaving the use side heat exchanger 26*a* flows into the flow control valve 25*a*. At this time, the flow control valve 25*a* allows only the amount of heat medium required to compensate for an air conditioning load needed in the air-conditioning target area, such as an indoor space, to flow into the use side heat exchanger 26*a*. The other heat medium flows through the bypass 27*a* so as to bypass the use side heat exchanger 26*a*. The heat medium passing through the bypass 27*a* does not contribute to heat exchange and merges with the heat medium leaving the use side heat exchanger 26*a*. The resultant heat medium passes through the flow switching valve 23*a* and flows into the first intermediate heat exchanger 15*a* and is then again sucked into the first pump 21*a*.

Similarly, the heat medium leaving the use side heat exchanger 26*b* flows into the flow control valve 25*b*. At this time, the flow control valve 25*b* allows only the amount of heat medium required to compensate for an air conditioning load needed in the air-conditioning target area, such as an indoor space, to flow into the use side heat exchanger 26*b*. The other heat medium flows through the bypass 27*b* so as to bypass the use side heat exchanger 26*b*. The heat medium passing through the bypass 27*b* does not contribute to heat exchange and merges with the heat medium leaving the use side heat exchanger 26*b*. The resultant heat medium passes through the flow switching valve 23*b* and flows into the second intermediate heat exchanger 15*b* and is then again sucked into the second pump 21*b*.

Throughout this mode, the flow switching valves 22 (the flow switching valve 22*a* and the flow switching valve 22*b*) and the flow switching valves 23 (the flow switching valve 23*a* and the flow switching valve 23*b*) allow the warm heat medium and the cold heat medium to flow into the use side heat exchanger 26*a* having the heating energy load and the use side heat exchanger 26*b* having the cooling energy load, respectively, without mixing with each other. Note that the air conditioning load needed in each air-conditioning target area, such as an indoor space, can be provided by controlling the difference between a temperature detected by the third temperature sensor 33 and a temperature detected by the fourth temperature sensor 34 at a target value.

In this case, it is unnecessary to supply the heat medium to each use side heat exchanger 26 having no thermal load (including thermo-off). Accordingly, the corresponding stop valve 24 is closed to block the passage such that the heat medium does not flow into the use side heat exchanger 26. In FIG. 7, the heat medium is allowed to flow into the use side heat exchanger 26*a* and the use side heat exchanger 26*b* because these heat exchangers each have a thermal load. The use side heat exchanger 26*c* and the use side heat exchanger 26*d* have no thermal load and the corresponding stop valves 24*c* and 24*d* are closed. If a heating energy load or a cooling energy load is generated in the use side heat exchanger 26*c* or the use side heat exchanger 26*d*, the stop valve 24*c* or the stop valve 24*d* may be opened such that the heat medium is circulated.

(Process of Detecting Abnormal Reduction in Flow Rate of Heat Medium)

A process of detecting an excessive reduction in flow rate of the heat medium in any heat medium circuit in the air-conditioning apparatus 100 according to Embodiment 1 caused by, for example, blockage of pipes during the cooling operation will now be described.

In the following description, let TE denote the temperature (e.g., an evaporating temperature that is the temperature of the refrigerant passing through the refrigerant passage when the heat source side refrigerant has a low temperature) of the heat source side refrigerant passing through the refrigerant passage of the intermediate heat exchanger 15, let T32 denote the heat medium inlet side temperature related to the intermediate heat exchanger 15 detected by the second temperature sensor 32, and let T31 denote the heat medium outlet side temperature related to the intermediate heat exchanger 15 detected by the first temperature sensor 31.

Figure 8:
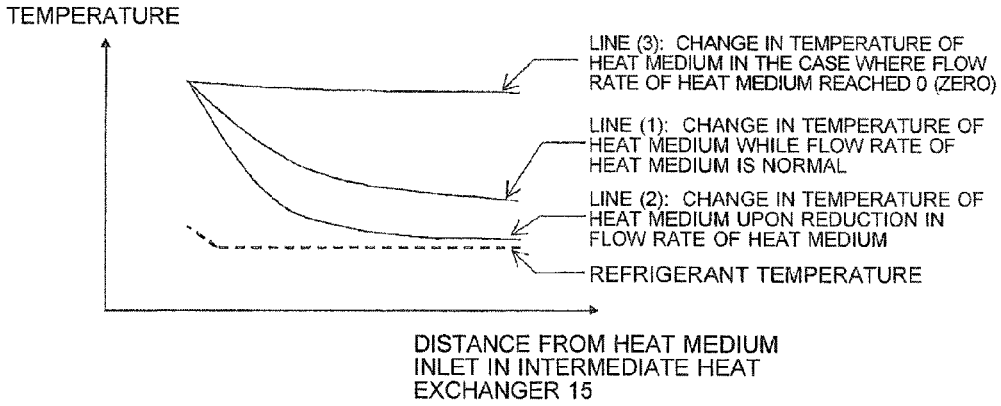
FIG. 8 is a graph illustrating a change in temperature of the refrigerant passing through an intermediate heat exchanger 15 and changes in temperature of a heat medium passing therethrough in Embodiment 1 of the present invention.

FIG. 8 is a graph illustrating a change in temperature of the refrigerant passing through the intermediate heat exchanger 15 and changes in temperature of the heat medium passing therethrough in Embodiment 1 of the present invention. In FIG. 8, the axis of ordinates denotes the temperature of the heat medium or the refrigerant and the axis of abscissas denotes the distance from a heat medium inlet in the intermediate heat exchanger 15. In addition, the broken line denotes the refrigerant temperature and each solid line denotes the heat medium temperature. The following description is applied to a typical heat exchanger as well as the intermediate heat exchanger 15.

A typical air-conditioning apparatus is designed such that a temperature efficiency ratio $\epsilon e$ is approximately 0.7 (70%). The temperature efficiency ratio $\epsilon e$ is the ratio of the difference (T32−TE) between the heat medium inlet side temperature related to the intermediate heat exchanger 15 and the refrigerant temperature in the intermediate heat exchanger 15 to the difference (T32−T31) between the heat medium inlet side temperature related to the intermediate heat exchanger 15 and the heat medium outlet side temperature related thereto. Accordingly, for example, when the heat medium flows through the heat medium circuit (or the heat medium passage of the intermediate heat exchanger 15) at a normal flow rate, the heat medium temperature during the cooling operation is indicated by LINE (1) in FIG. 8 in relation to the refrigerant temperature in the intermediate heat exchanger 15.

As the flow rate of the heat medium decreases, however, the heat medium outlet side temperature related to the intermediate heat exchanger 15 approaches the refrigerant temperature because the amount of heat exchanged between the heat medium and the refrigerant increases. Consequently, the temperature efficiency ratio $\epsilon e$ tends to be large as indicated by LINE (2) in FIG. 8. Furthermore, when the flow rate of the heat medium reaches 0 (zero) (or the heat medium stops flowing), the heat medium inlet side temperature related to the intermediate heat exchanger 15 and the heat medium outlet side temperature related thereto are significantly affected by an ambient temperature. As regards the heat medium inlet side temperature T32 detected by the second temperature sensor 32 and the heat medium outlet side temperature T31 detected by the first temperature sensor 31, therefore, these temperature sensors each detect the temperature of ambient air rather than the heat medium temperature. Consequently, there is little or no difference (T32−T31) between the heat medium inlet side temperature related to the intermediate heat exchanger 15 and the heat medium outlet side temperature related thereto. The temperature efficiency ratio $\epsilon e$ tends to become small as indicated by LINE (3) in FIG. 8.

The above-described fact reveals that the temperature efficiency ratio $\epsilon e$ has a proper range. When the temperature efficiency ratio $\epsilon e$ exceeds the proper range, therefore, the flow of the heat medium in the heat medium circuit can be determined as abnormal. This tendency is generally common to heat exchange between the heat medium and air. Accordingly, for example, abnormality in flow rate of the heat medium can be determined on the basis of the sucked air temperature, Ta, detected by the eighth temperature sensor 39. Although FIG. 8 illustrates the change in temperature of the heat source side refrigerant and the changes in temperature of the heat medium during the cooling operation, the same applies to a case where the heat source side refrigerant has a high temperature, for example, the heating operation (but the relationship between temperature levels is reversed).

For comparison, a reference temperature efficiency ratio $\epsilon the$ is set based on measurement or the like in advance. The reference temperature efficiency ratio $\epsilon the$ is the reference of the temperature efficiency ratio obtained when the heat medium flows in a normal state. Although the reference temperature efficiency ratio $\epsilon the$ may be constant, the reference temperature efficiency ratio $\epsilon the$ increases or decreases depending on, for example, the flow rate (flow rate per unit time) of the heat medium. To perform the detecting process, therefore, the controller 60 may set the reference temperature efficiency ratio $\epsilon the$ depending on the flow rate by, for example, estimating the flow rate of the heat medium on the basis of a rotation speed of the pump 21.

The controller 60, therefore, calculates an actual temperature efficiency ratio (hereinafter, referred to as the "actual temperature efficiency ratio") $\epsilon e$=(T32−T31)/(T32−TE) on the basis of the refrigerant temperature TE, the heat medium outlet side temperature T31, and the heat medium inlet side temperature T32 detected actually. Then, the controller 60 determines whether the difference between the actual temperature efficiency ratio $\epsilon e$ and the reference temperature efficiency ratio $\epsilon the$ is within a predetermined range. When determining that the difference is within the predetermined range, the controller 60 determines that the heat medium is circulated at a normal flow rate through the heat medium circuit without a reduction in flow rate due to, for example, the leakage of the heat medium or a failure of the pump 21.

Furthermore, an excessive reduction in flow rate of the heat medium in the heat medium circuit of the air-conditioning apparatus 100 during the heating operation caused by, for example, the leakage of the refrigerant is similarly detected. For example, let TC denote the temperature (e.g., a condensing temperature that is the temperature of the refrigerant passing through the refrigerant passage when the refrigerant has a high temperature) of the refrigerant passing through the refrigerant passage of the intermediate heat exchanger 15.

The controller 60 calculates an actual temperature efficiency ratio $\epsilon c$=(T31−T32)/(TC−T32) on the basis of the refrigerant temperature TC, the heat medium outlet side temperature T31, and the heat medium inlet side temperature T32 detected actually. When determining that the difference between the actual temperature efficiency ratio ϵc and a reference temperature efficiency ratio ϵthc is within a predetermined range, the controller 60 determines that the heat medium is circulated at a normal flow rate through the heat medium circuit.

For example, while the operation of the refrigeration cycle is stopped, the refrigerant temperature TE is not detected. Accordingly, it is difficult to calculate the actual temperature efficiency ratio ϵe on the basis of the refrigerant temperature TE in order to determine an abnormal flow rate of the heat medium. As described above, therefore, a change in temperature efficiency ratio for heat exchange between the heat medium and air with decreasing heat medium flow rate is used for determination based on the sucked air temperature Ta detected by the eighth temperature sensor 39. The sucked air temperature Ta may be the mean of sucked air temperatures related to the indoor units 2 performing the cooling operation. Alternatively, the sucked air temperature related to any of the indoor units 2 performing the cooling operation may be representatively used as the sucked air temperature Ta.

The controller 60 calculates an actual temperature efficiency ratio ϵa=(T31−T32)/(Ta−T32) on the basis of the sucked air temperature Ta, the heat medium outlet side temperature T31, and the heat medium inlet side temperature T32, and determines whether the difference between the actual temperature efficiency ratio ϵa and a reference temperature efficiency ratio ϵtha is within a predetermined range. When determining that the difference is within the predetermined range, the controller 60 determines that the heat medium flows at a normal flow rate.

Figure 9:
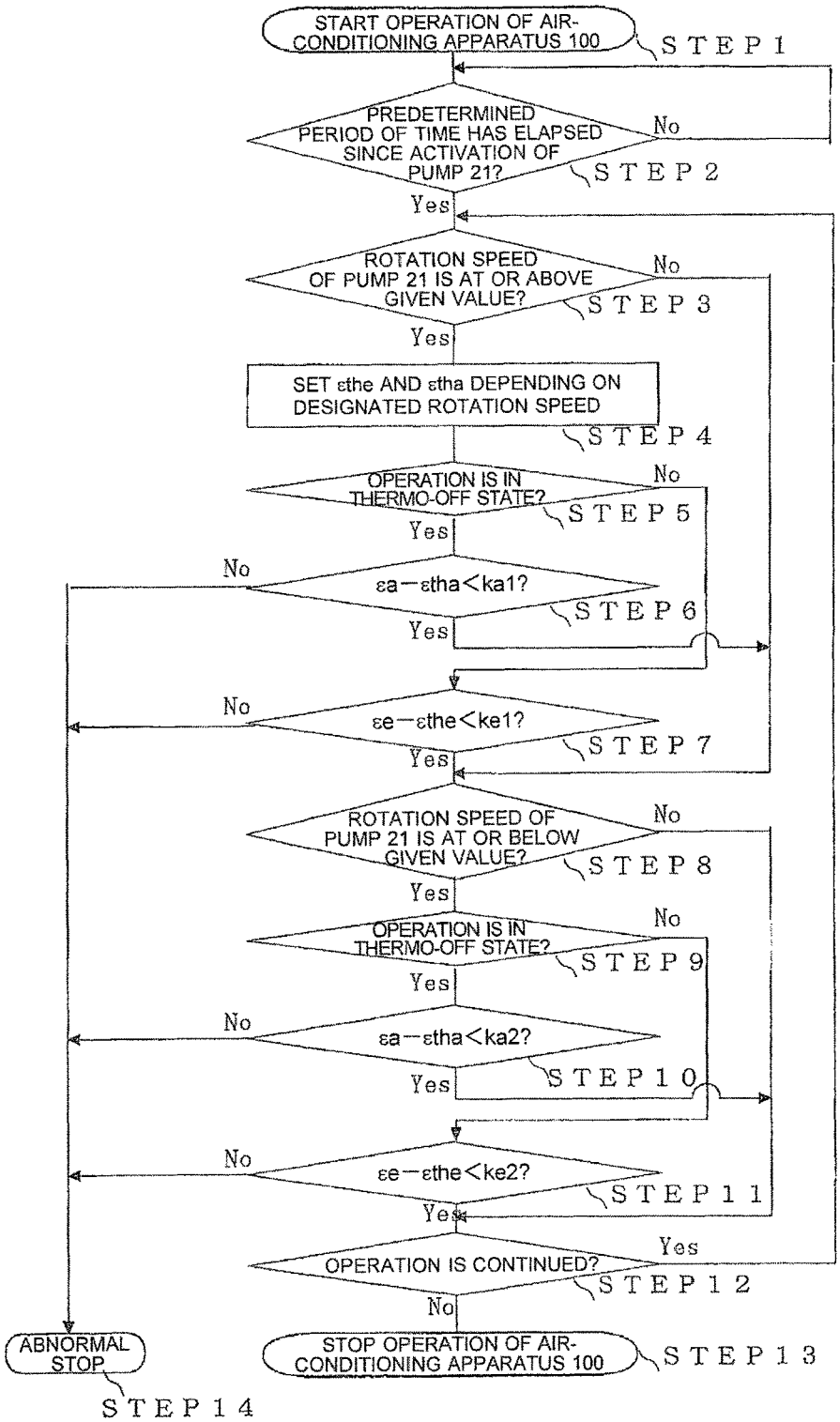
FIG. 9 is a diagram for explaining a process, performed by a controller 60 in Embodiment 1 of the present invention, of determining an abnormal flow rate of the heat medium during the cooling operation.

FIG. 9 is a diagram for explaining the process, performed by the controller 60 in Embodiment 1 of the present invention, of determining an abnormal flow rate of the heat medium during the cooling operation. Specific protection control for the heat medium circuit will be described with reference to FIG. 9. In STEP 1, the operation of the air-conditioning apparatus 100 is started. In STEP 2, the controller 60 determines whether a predetermined period of time has elapsed since activation of the pump 21. When determining that the predetermined period of time has elapsed, the controller 60 proceeds to STEP 3.

In STEP 3, the controller 60 determines whether the rotation speed of the pump 21 is at or above a given rotation speed. The given rotation speed used as a reference for the pump 21 is determined in advance. Since the lengths of the pipes (for example, the total length thereof), the diameters of the pipes, and the like in the heat medium circuit may vary from air-conditioning apparatus 100 to another, the given rotation speed may be determined on the basis of the configuration or the like of the air-conditioning apparatus 100.

When determining that the rotation speed of the pump 21 is at or above the given rotation speed, the controller 60 proceeds to STEP 4. On the other hand, when determining that it is not at or above the given rotation speed (i.e., below the given rotation speed), the controller 60 proceeds to STEP 8. In STEP 4, the controller 60 sets the reference temperature efficiency ratios ϵthe and ϵtha depending on a designated rotation speed of the pump 21 and then proceeds to STEP 5.

In STEP 5, the controller 60 determines whether the operation is in a thermo-off state (in which the operation is not performed in the refrigeration cycle). When determining that the operation is in the thermo-off state, the controller 60 proceeds to STEP 6. On the other hand, when determining that the operation is not in the thermo-off state, the controller 60 proceeds to STEP 7.

In STEP 6, since the operation is not performed in the refrigeration cycle, the controller 60 calculates the actual temperature efficiency ratio ϵa on the basis of the sucked air temperature Ta, the heat medium outlet side temperature T31, and the heat medium inlet side temperature T32 as described above, and then compares the actual temperature efficiency ratio ϵa with the reference temperature efficiency ratio ϵtha set in advance. When determining that the difference between the temperature efficiency ratios is less than a given value ka1, the controller 60 proceeds to STEP 8. On the other hand, when determining that the difference between the actual temperature efficiency ratio ϵa and the reference temperature efficiency ratio ϵtha is greater than or equal to the given value, the controller 60 determines there is abnormality and proceeds to STEP 14.

On the other hand, in STEP 7, since the operation is performed in the refrigeration cycle, the controller 60 calculates the actual temperature efficiency ratio ϵe on the basis of the refrigerant temperature TE, the heat medium outlet side temperature T31, and the heat medium inlet side temperature T32, and then compares the actual temperature efficiency ratio ϵe with the set reference temperature efficiency ratio ϵthe. When determining that the difference therebetween is less than a given value ke1, the controller 60 proceeds to STEP 8. When determining that the difference between the actual temperature efficiency ratio ϵe and the reference temperature efficiency ratio ϵthe is greater than or equal to the given value, the controller 60 determines there is abnormality and proceeds to STEP 14.

In STEP 8, the controller 60 determines whether the rotation speed of the pump 21 is at or below a given rotation speed. This predetermined rotation speed used as a reference for the pump 21 is determined in advance. When determining that the rotation speed of the pump 21 is at or below the given rotation speed, the controller 60 proceeds to STEP 9. When determining that the ration speed of the pump 21 is not at or below the given rotation speed (i.e., the rotation speed of the pump 21 is above the given rotation speed), the controller 60 proceeds to STEP 12. In STEP 9, the controller 60 determines whether the operation is in the thermo-off state. When determining that the operation is in the thermo-off state, the controller 60 proceeds to STEP 10. When determining that the operation is not in the thermo-off state, the controller 60 proceeds to STEP 11.

In STEP 10, since the operation is not performed in the refrigeration cycle, the controller 60 calculates the actual temperature efficiency ratio ϵa on the basis of the sucked air temperature Ta, the heat medium outlet side temperature T31, and the heat medium inlet side temperature T32 as described above, and then compares the actual temperature efficiency ratio ϵa with the reference temperature efficiency ratio ϵtha set in advance. When determining that the difference between these ratios is less than a given value ka2, the controller 60 proceeds to STEP 12. On the other hand, when determining that the difference between the actual temperature efficiency ratio ϵa and the reference temperature efficiency ratio ϵtha is greater than or equal to the given value, the controller 60 determines there is abnormality and proceeds to STEP 14.

On the other hand, in STEP 11, since the operation is performed in the refrigeration cycle, the controller 60 calculates the actual temperature efficiency ratio ϵe on the basis of the refrigerant temperature TE, the heat medium outlet side temperature T31, and the heat medium inlet side temperature T32, and then compares the actual temperature efficiency ratio ϵe with the set reference temperature efficiency ratio ϵthe. When determining that the difference between these ratios is less than a given value ke2, the controller 60 proceeds to STEP 12. When determining that the difference between the actual temperature efficiency ratio ϵe and the reference temperature efficiency ratio ϵthe is greater than or equal to the given value, the controller 60 determines there is abnormality and proceeds to STEP 14.

In STEP 12, the controller 60 determines whether to continue the air conditioning operation. When determining the continuation, the controller 60 returns to STEP 2 and repeats the determination. When determining the discontinuation of the air conditioning operation, the controller 60 proceeds to STEP 13 and stops the air conditioning operation, thus terminating the process.

Figure 10:
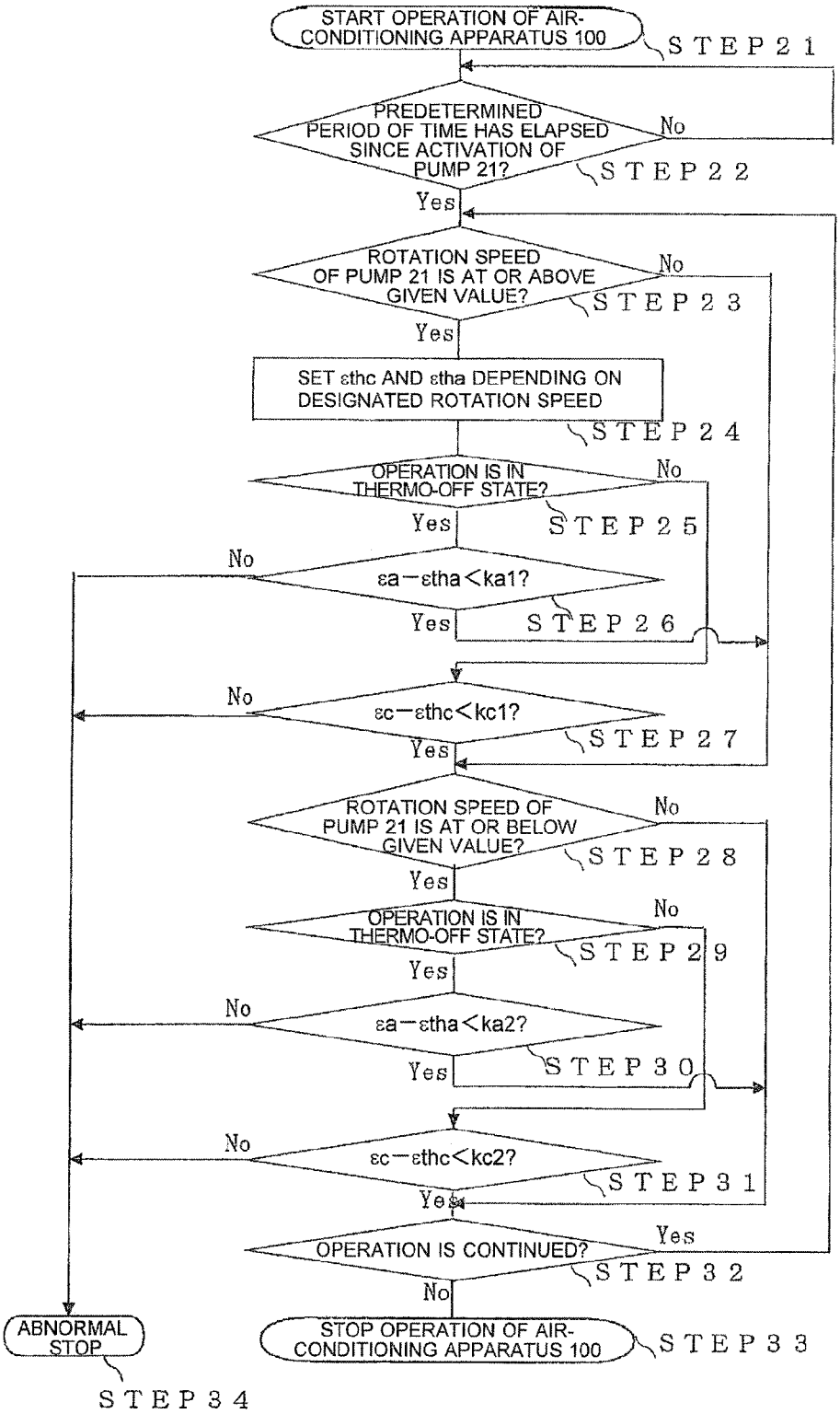
FIG. 10 is a diagram for explaining a process, performed by the controller 60 in Embodiment 1 of the present invention, of determining an abnormal flow rate of the heat medium during the heating operation.

FIG. 10 is a diagram for explaining a process, performed by the controller 60 in Embodiment 1 of the present invention, of determining an abnormal flow rate of the heat medium during the heating operation. Specific protection control for the heat medium circuit will be described with reference to FIG. 10. In STEP 21, the operation of the air-conditioning apparatus 100 is started. In STEP 22, the controller 60 determines whether a predetermined period of time has elapsed since activation of the pump 21. When determining that the predetermined period of time has elapsed, the controller 60 proceeds to STEP 23.

In STEP 23, the controller 60 determines whether the rotation speed of the pump 21 is at or above a given rotation speed. The given rotation speed used as a reference for the pump 21 is determined in advance. Since the lengths of the pipes (for example, the total length thereof), the diameters of the pipes, and the like in the heat medium circuit may vary from air-conditioning apparatus 100 to another, the given rotation speed may be determined on the basis of the configuration or the like of the air-conditioning apparatus 100.

When determining that the rotation speed of the pump 21 is at or above the given rotation speed, the controller 60 proceeds to STEP 24. On the other hand, when determining that the rotation speed of the pump 21 is not at or above the given rotation speed (i.e., below the given rotation speed), the controller 60 proceeds to STEP 28. In STEP 24, the controller 60 sets the reference temperature efficiency ratios ϵthc and ϵtha depending on a designated rotation speed of the pump 21 and proceeds to STEP 25.

In STEP 25, the controller 60 determines whether the operation is in the thermo-off state (in which the operation is not performed in the refrigeration cycle). When determining that the operation is in the thermo-off state, the controller 60 proceeds to STEP 26. When determining that the operation is not in the thermo-off state, the controller 60 proceeds to STEP 27.

In STEP 26, since the operation is not performed in the refrigeration cycle, the controller 60 calculates the actual temperature efficiency ratio ϵa on the basis of the sucked air temperature Ta, the heat medium outlet side temperature T31, and the heat medium inlet side temperature T32 as described above, and then compares the actual temperature efficiency ratio ϵa with the reference temperature efficiency ratio ϵtha set in advance. When determining that the difference between these ratios is less than the given value ka1, the controller 60 proceeds to STEP 28. When determining that the difference between the actual temperature efficiency ratio ϵa and the reference temperature efficiency ratio ϵtha is greater than or equal to the given value, the controller 60 determines there is abnormality and proceeds to STEP 34.

On the other hand, in STEP 27, since the operation is performed in the refrigeration cycle, the controller 60 calculates the actual temperature efficiency ratio ϵc on the basis of the refrigerant temperature TC, the heat medium outlet side temperature T31, and the heat medium inlet side temperature T32, and then compares the actual temperature efficiency ratio ϵc with the set reference temperature efficiency ratio ϵthc. When determining that the difference between these ratios is less than a given value kc1, the controller 60 proceeds to STEP 28. When determining that the difference between the actual temperature efficiency ratio ϵc and the reference temperature efficiency ratio ϵthc is greater than or equal to the given value, the controller 60 determines there is abnormality and proceeds to STEP 34.

In STEP 28, the controller 60 determines whether the rotation speed of the pump 21 is at or below a given rotation speed. The predetermined rotation speed used as a reference for the pump 21 is determined in advance. When determining that the rotation speed of the pump 21 is at or below the given rotation speed, the controller 60 proceeds to STEP 29. When determining that the rotation speed of the pump 21 is not at or below the given rotation speed (i.e., the rotation speed of the pump 21 is above the given rotation speed), the controller 60 proceeds to STEP 32. In STEP 29, the controller 60 determines whether the operation is in the thermo-off state. When determining that the operation is in the thermo-off state, the controller 60 proceeds to STEP 30. When determining that the operation is not in the thermo-off state, the controller 60 proceeds to STEP 31.

In STEP 30, since the operation is not performed in the refrigeration cycle, the controller 60 calculates the actual temperature efficiency ratio ϵa on the basis of the sucked air temperature Ta, the heat medium outlet side temperature T31, and the heat medium inlet side temperature T32 as described above, and then compares the actual temperature efficiency ratio ϵa with the reference temperature efficiency ratio ϵtha set in advance. When determining that the difference between these ratios is less than the given value ka2, the controller 60 proceeds to STEP 32. When determining that the difference between the actual temperature efficiency ratio ϵa and the reference temperature efficiency ratio ϵtha is greater than or equal to the given value, the controller 60 determines there is abnormality and proceeds to STEP 34.

On the other hand, in STEP 31, since the operation is performed in the refrigeration cycle, the controller 60 calculates the actual temperature efficiency ratio ϵc on the basis of the refrigerant temperature TC, the heat medium outlet side temperature T31, and the heat medium inlet side temperature T32, and then compares the actual temperature efficiency ratio ϵc with the set reference temperature efficiency ratio ϵthc. When determining that the difference between these ratios is less than a given value kc2, the controller 60 proceeds to STEP 32. When determining that the difference between the actual temperature efficiency ratio ϵc and the reference temperature efficiency ratio ϵthc is greater than or equal to the given value, the controller 60 determines there is abnormality and proceeds to STEP 34.

In STEP 32, the controller 60 determines whether to continue the air conditioning operation. When determining the continuation, the controller 60 returns to STEP 22 and repeats the determination. When determining the discontinuation of the air conditioning operation, the controller 60 proceeds to STEP 33 and stops the air conditioning operation, thus terminating the process.

For example, when a cooling and heating mixed operation is performed, the heat medium system is separated into a heat medium system including the pipes 5*a* and a heat medium system including the pipes 5*b*. In this case, an abnormal flow rate of the heat medium is determined in each system. When abnormality is determined in one system, for example, the circulation of the heat medium is stopped. In the other system in which no abnormality is determined to be present, the pump 21 may be driven to continue the air conditioning operation.

When the abnormal flow rate of the heat medium is determined by the above-described process and at least one pump 21 is stopped, the controller 60 allows the annunciator 62 to provide information about the occurrence of abnormality.

While the operation is being continued, the information about the occurrence of abnormality is provided to the outside in this manner to prompt maintenance, for example. This allows an abnormal condition to be immediately dealt with, so that a process of restoration to a normal condition can be performed at once.

As described above, in the air-conditioning apparatus 100 according to Embodiment 1, the controller 60 determines whether abnormality in flow rate has occurred in the heat medium circuit on the basis of the temperature efficiency ratio related to heat exchange by the intermediate heat exchanger 15 or the use side heat exchanger 26. Accordingly, an abnormal flow rate can be determined accurately and efficiently. For example, in case of the leakage of the heat medium, an increase in load to the pump 21 caused by a reduction in flow rate can be expected to be immediately dealt with. Furthermore, in case of breakdown or the like of the pump 21, the occurrence of breakdown or the like can be expected to be immediately detected. In addition, since an abnormal flow rate can be determined using the sensors typically used for air conditioning control, determination or the like can be achieved in a cost-efficient manner.

Embodiment 2

In Embodiment 1 described above, the actual temperature efficiency ratio $\epsilon a$ is calculated using the heat medium inlet side temperature T32 related to the intermediate heat exchanger 15 detected by the second temperature sensor 32 and the heat medium outlet side temperature T31 related to the intermediate heat exchanger 15 detected by the first temperature sensor 31. The calculation is not limited to this manner. For example, the actual temperature efficiency ratio $\epsilon a$ may be calculated using an incoming heat medium temperature related to the use side heat exchanger 26 detected by the third temperature sensor 33 and an outgoing heat medium temperature related to the use side heat exchanger 26 detected by the fourth temperature sensor 34.

Embodiment 3

In Embodiment 1 described above, for example, the first intermediate heat exchanger 15*a* is used as a heat exchanger for heating the heat medium and the second intermediate heat exchanger 15*b* is used as a heat exchanger for cooling the heat medium. The configuration of the refrigeration cycle is not limited to that in Embodiment 1. For example, the first intermediate heat exchanger 15*a* and the second intermediate heat exchanger 15*b* can be configured to be capable of heating and cooling the heat medium. In such a configuration, both the first intermediate heat exchanger 15*a* and the second intermediate heat exchanger 15*b* can be used as heating devices in the heating only operation mode or cooling devices in the cooling only operation mode.

During the cooling and heating mixed operation, if the heating operation is performed in one system in which the pump 21 is stopped because abnormality in flow rate has been determined, the cooling operation performed in the other system may be switched to the heating operation (and vice versa). As regards a criterion for the determination as to whether to switch between the operations, for example, the operation designated first can be preferentially performed, or alternatively the operation with a larger total amount of heat exchanged in the use side heat exchangers 26 can be preferentially performed.

Although the air-conditioning apparatus 100 including at least two intermediate heat exchangers 15 for achieving the cooling and heating mixed operation or the like has been described in Embodiment 1, the present invention can be applied to, for example, an air-conditioning apparatus including a single intermediate heat exchanger. Furthermore, the invention can be applied to an air-conditioning apparatus including a single indoor unit 2.

Although the heat medium is heated or cooled using the refrigeration cycle through which the heat source side refrigerant is circulated in Embodiment 1, the heat medium may be heated or cooled by any device.

Embodiment 4

Figure 11:
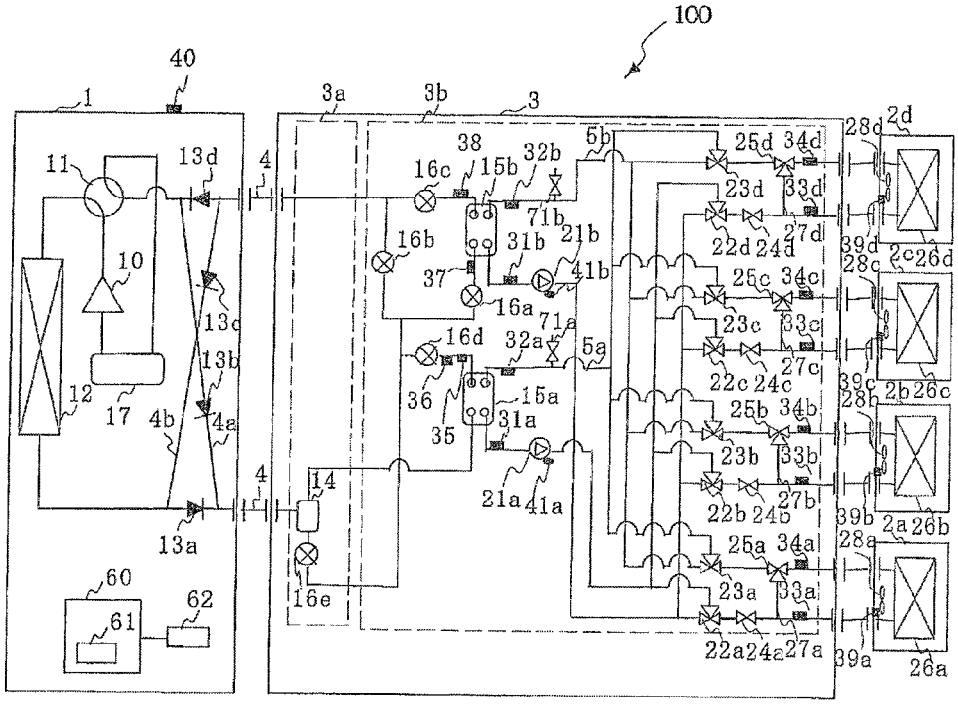
FIG. 11 is a schematic circuit diagram illustrating the configuration of an air-conditioning apparatus according to Embodiment 4.

FIG. 11 is a schematic circuit diagram illustrating the configuration of an air-conditioning apparatus 100 according to Embodiment 4 of the present invention. In Embodiment 1 described above, each pump 21 is not particularly specified. According to Embodiment 4, each pump 21 includes a rotation speed sensor 41 (41*a*, 41*b*), serving as a rotation speed detecting device, for detecting an actual rotation speed (actual rotation speed) of the pump 21. Furthermore, the pump 21 is a centrifugal pump. The rotation speed of the centrifugal pump can be controlled by an inverter. Although the rotation speed of the pump 21 typically varies depending on pump head of the pump 21, the actual rotation speed of the pump 21 varies within a range limited by, for example, restrictions of a product.

Figure 12:
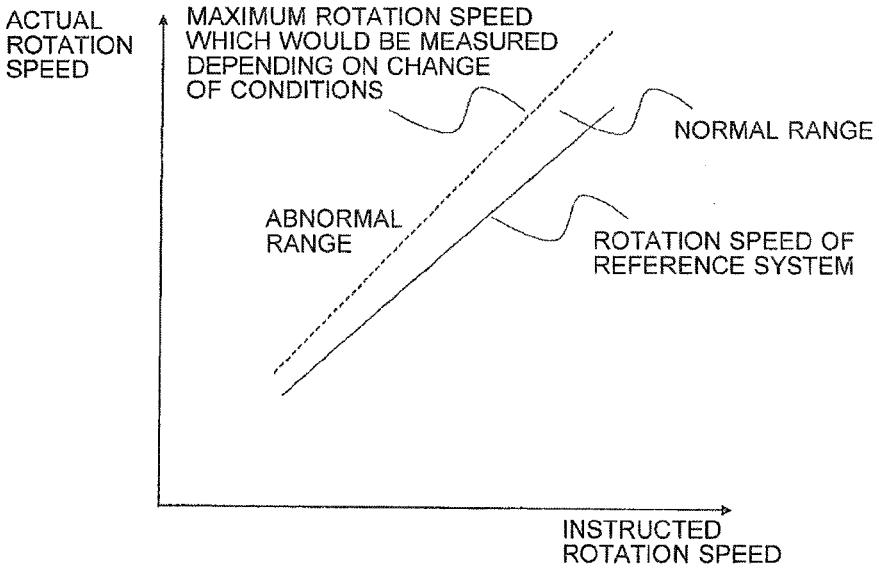
FIG. 12 is a graph illustrating the relationship between a command rotation speed and an actual rotation speed of a pump 21.

FIG. 12 is a graph illustrating the relationship between a command rotation speed and the actual rotation speed of the pump 21. FIG. 12 demonstrates that, for example, while the pump 21 is normally driven, the pump 21 is driven in a normal range in the graph that depicts the actual rotation speed plotted against the command rotation speed of the pump 21, and when the actual rotation speed increases relative to the command rotation speed beyond the normal range, the increased rotation speed is abnormal.

For example, if air enters the heat medium circuit, the work load of the pump 21 would decrease depending on the amount of air entered. When the supply of the same amount of power as that in a state where no air enters the heat medium circuit is provided, therefore, the rotation speed of the pump 21 would tend to increase. In particular, if the amount of air entered is at or above a given value, the pump 21 would be driven at an actual rotation speed which would never be measured in the normal state and the relationship between the command rotation speed and the actual rotation speed would be at a position in an abnormal range in FIG. 12, for example.

Data indicating the relationship between the command rotation speed and the actual rotation speed mapped in the normal range and that mapped in the abnormal range is stored in the controller 60 in advance in FIG. 12. The controller 60 determines whether the actual rotation speed of the pump 21 detected by the rotation speed detecting sensor 41 is normal or abnormal at regular time intervals. When determining that the actual rotation speed is abnormal, for example, the controller 60 stops the operation of the relay unit 3 (or stops the pump 21) and allows the annunciator 62 to provide information about such a state.

As described above, according to Embodiment 4, an operation state is directly monitored on the basis of the actual rotation speed of the pump 21 detected by the rotation speed detecting sensor 41 to determine whether abnormality has occurred, and the pump 21 can be controlled. Thus, whether abnormality has occurred can be accurately determined. In addition, for example, since the entry of air into a heat medium circulating circuit can be determined before the pump 21 is damaged, such a problem can be immediately dealt with.

Embodiment 5

Figure 13:
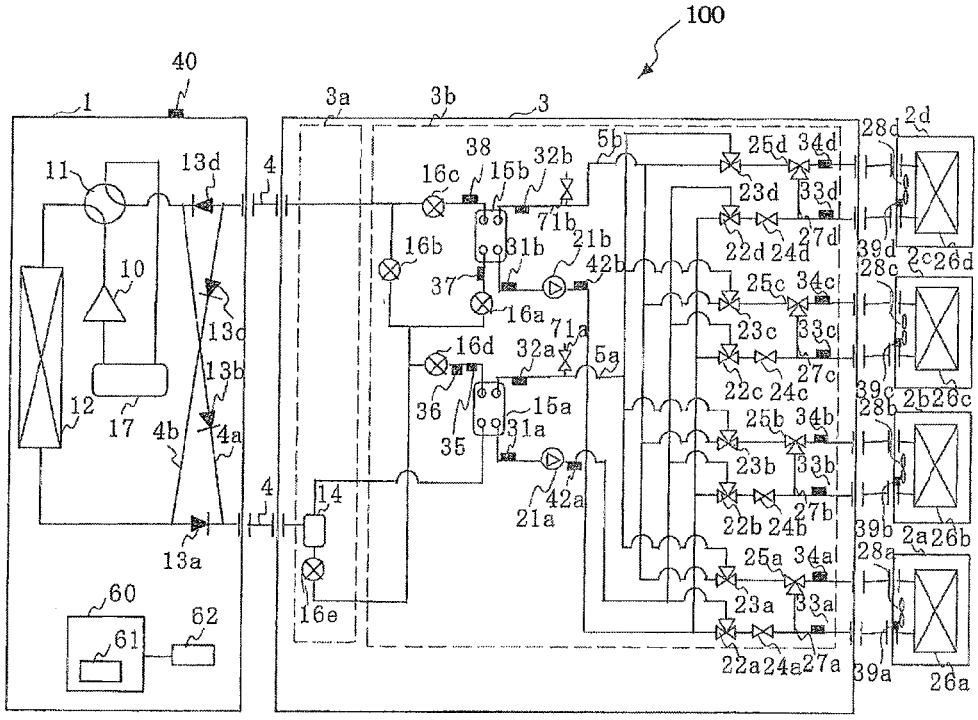
FIG. 13 is a schematic circuit diagram illustrating the configuration of an air-conditioning apparatus according to Embodiment 5.

FIG. 13 is a schematic circuit diagram illustrating the configuration of an air-conditioning apparatus 100 according to Embodiment 5 of the present invention. According to Embodiment 5, a tenth temperature sensor (pump temperature detecting device) 42, not particularly illustrated in Embodiment 1 described above, is disposed near, for example, a heat medium inlet or outlet of each pump 21 so that the temperature of the pump 21 can be indirectly detected. For example, if the heat medium circuit is blocked and the heat medium is not circulated, impellers of the pump 21 will keep rotating due to driving of a motor unless the pump 21 is stopped. Consequently, the motor or the like will generate heat and an internal temperature of the pump 21 will accordingly increase. The increased internal temperature will affect convection or heat conduction, thus resulting in an increase in temperature near a heat medium inlet or a heat medium outlet of the pump 21.

The above-described characteristics are taken into consideration, an upper limit temperature at which the pump 21 is free from damage or the like is determined in advance through testing or the like, and data indicating the limit value is stored in the controller 60. The controller 60 determines whether a temperature detected by the tenth temperature sensor 42 disposed near the heat medium inlet or outlet of the pump 21 has exceeded the limit value at regular time intervals. When determining that the temperature has exceeded the limit value and such a state is accordingly abnormal, for example, the controller 60 stops the operation of the relay unit 3 (or stops the pump 21) and allows the annunciator 62 to provide information about such a state.

The tenth temperature sensor 42 may be disposed near any one or each of the heat medium inlet and outlet of the pump 21. Alternatively, the tenth temperature sensor 42 may be disposed at a position where the sensor is easily placed inside the pump 21 and the internal temperature of the pump 21 may be directly detected.

As described above, according to Embodiment 5, the temperature of the pump 21 is monitored on the basis of a temperature detected by the tenth temperature sensor 42 to determine whether abnormality has occurred, and the pump 21 can be controlled. Thus, whether abnormality has occurred can be accurately determined. In addition, for example, since the entry of air into the heat medium circulating device can be determined before the pump 21 is damaged, such a problem can be immediately dealt with.

The invention claimed is:

1. An air-conditioning apparatus comprising:

a refrigeration cycle including a pipe, a compressor configured to compress a heat source side refrigerant, a refrigerant flow switching device configured to switch between paths for circulation of the heat source side refrigerant, a heat source side heat exchanger configured to allow the heat source side refrigerant to exchange heat, an expansion device configured to regulate a pressure of the heat source side refrigerant, and at least one intermediate heat exchanger configured to exchange heat between the heat source side refrigerant and a heat medium different from the heat source side refrigerant;

a heat medium circuit including a pipe, at least one pump configured to circulate the heat medium for heat exchange by the intermediate heat exchanger, a use side heat exchanger configured to exchange heat between the heat medium and air in an air-conditioning target space, and a flow switching valve configured to switch between passing a heated heat medium through the use side heat exchanger and passing a cooled heat medium through the use side heat exchanger; and a controller configured to calculate an actual temperature efficiency ratio based on a temperature at a heat medium inlet of the intermediate heat exchanger or the use side heat exchanger in the heat medium circuit and determine whether a flow rate of the heat medium in the heat medium circuit is abnormal based on a difference between the actual temperature efficiency ratio and a set reference temperature efficiency ratio, wherein the controller is configured to set the reference temperature efficiency ratio based on a rotation speed of the pump.

2. The air-conditioning apparatus of claim 1, further comprising:

an incoming heat medium temperature detecting device configured to detect a temperature at a heat medium inlet of the intermediate heat exchanger; and an outgoing heat medium temperature detecting device configured to detect a temperature at a heat medium outlet of the intermediate heat exchanger, wherein the controller calculates an actual temperature efficiency ratio based on the temperature at the heat medium inlet, the temperature at the heat medium outlet, and the temperature of the heat source side refrigerant passing through the intermediate heat exchanger and determines whether the flow rate of the heat medium in the heat medium circuit is abnormal based on the actual temperature efficiency ratio and the set reference temperature efficiency ratio.

3. The air-conditioning apparatus of claim 1, further comprising:

an incoming heat medium temperature detecting device configured to detect a temperature at a heat medium inlet of the intermediate heat exchanger;

an outgoing heat medium temperature detecting device configured to detect a temperature at a heat medium outlet of the intermediate heat exchanger; and an air-conditioning target temperature detecting device configured to detect the temperature of air flowing into the use side heat exchanger, wherein the controller calculates an actual temperature efficiency ratio based on the temperature at the heat medium inlet, the temperature at the heat medium outlet, and the temperature of the air flowing into the use side heat exchanger and determines whether the flow rate of the heat medium in the heat medium circuit is abnormal based on the actual temperature efficiency ratio and the set reference temperature efficiency ratio.

4. The air-conditioning apparatus of claim 1, further comprising:

a use-side incoming temperature detecting device configured to detect a temperature at a heat medium inlet of the use side heat exchanger;

a use-side outgoing temperature detecting device configured to detect a temperature at a heat medium outlet of the use side heat exchanger; and an air-conditioning target temperature detecting device configured to detect the temperature of air flowing into the use side heat exchanger, wherein the controller calculates an actual temperature efficiency ratio based on the temperature at the heat medium inlet, the temperature at the heat medium outlet, and the temperature of the air flowing into the use side heat exchanger and determines whether the flow rate of the heat medium in the heat medium circuit is abnormal based on the actual temperature efficiency ratio and a set reference temperature efficiency ratio.

5. The air-conditioning apparatus of claim 1, wherein when determining that the flow rate of the heat medium in the heat medium circuit is abnormal, the controller stops the pump.

6. The air-conditioning apparatus of claim 1, wherein when determining that a predetermined period of time has elapsed since activation of the pump, the controller starts to determine whether a flow rate of the heat medium is abnormal.

7. The air-conditioning apparatus of claim 1, further comprising a rotation speed detecting device configured to detect an actual rotation speed of the pump, wherein the controller determines whether the pump is in an abnormal condition based on a relationship between the actual rotation speed detected by the rotation speed detecting device and a designated rotation speed.

8. The air-conditioning apparatus of claim 1, further comprising a pump temperature detecting device configured to detect the temperature of the pump, wherein the controller determines whether the pump is in an abnormal condition based on the temperature detected by the pump temperature detecting device.

9. The air-conditioning apparatus of claim 1, further comprising an annunciator configured to provide information indicating abnormality, wherein when determining that the flow rate of the heat medium in the heat medium circuit is abnormal, the controller allows the annunciator to provide the information.

10. The air-conditioning apparatus of claim 2, wherein when determining that the flow rate of the heat medium in the heat medium circuit is abnormal, the controller stops the pump.

11. The air-conditioning apparatus of claim 3, wherein when determining that the flow rate of the heat medium in the heat medium circuit is abnormal, the controller stops the pump.

12. The air-conditioning apparatus of claim 4, wherein when determining that the flow rate of the heat medium in the heat medium circuit is abnormal, the controller stops the pump.

* * * * *